US006814164B2

(12) United States Patent
Mills et al.

(10) Patent No.: US 6,814,164 B2
(45) Date of Patent: Nov. 9, 2004

(54) PIPE LOADING DEVICE FOR A DIRECTIONAL DRILLING APPARATUS

(75) Inventors: Matthew Arlen Mills, Pella, IA (US); Gregg Alan Austin, Pella, IA (US); Steven C. Erickson, Lake in the Hills, IL (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 10/391,230

(22) Filed: Mar. 18, 2003

(65) Prior Publication Data

US 2004/0007388 A1 Jan. 15, 2004

Related U.S. Application Data

(63) Continuation-in-part of application No. 09/970,093, filed on Oct. 2, 2001, now Pat. No. 6,533,046, which is a continuation of application No. 09/321,988, filed on May 28, 1999, now Pat. No. 6,332,502.

(51) Int. Cl.[7] ..... E21B 19/20
(52) U.S. Cl. ..... 175/52; 414/22.62
(58) Field of Search ..... 175/52, 85; 166/77.51; 414/22.51, 22.52, 22.53, 22.63, 22.64, 22.62

(56) References Cited

U.S. PATENT DOCUMENTS

| | | | |
|---|---|---|---|
| 2,280,854 | A | 4/1942 | Rooney |
| 2,829,783 | A | 4/1958 | Blagg |
| 3,506,075 | A | 4/1970 | Attebo |
| 3,937,514 | A | 2/1976 | Langowski |
| 4,049,065 | A | 9/1977 | Walter |
| 4,128,135 | A | 12/1978 | Mitchhart et al. |
| RE30,071 | E | 8/1979 | Hilding et al. |
| 4,491,450 | A | 1/1985 | George |
| 5,355,965 | A | 10/1994 | Rozendaal |
| 5,460,480 | A | 10/1995 | Jubre et al. |
| 5,556,253 | A | 9/1996 | Rozendaal et al. |
| 5,607,280 | A | 3/1997 | Rozendaal |
| 5,931,238 | A | 8/1999 | Gilmore et al. |
| 6,085,852 | A | 7/2000 | Sparks et al. |
| 6,332,502 | B1 | 12/2001 | Mills et al. |
| 6,533,046 | B2 | 3/2003 | Mills et al. |

FOREIGN PATENT DOCUMENTS

| | | |
|---|---|---|
| DE | 197 15 082 A1 | 9/1997 |
| GB | 2166781 A | 5/1986 |
| GB | 2 312 006 | 10/1997 |
| WO | WO 95/00737 | 1/1995 |
| WO | WO 96/26349 | 8/1996 |
| WO | WO 00/75479 | 12/2000 |

OTHER PUBLICATIONS

US 5,806,613, Sep. 1998, Sparks et al. (withdrawn).

*Primary Examiner*—Robert E Pezzuto
(74) *Attorney, Agent, or Firm*—Merchant & Gould P.C.

(57) ABSTRACT

A drilling apparatus including a magazine for holding a plurality of pipes, and a drive head is disclosed herein. The drive head includes a drive member adapted to be coupled to a pipe. The drive member is aligned along a drive axis. The drilling apparatus includes a first drive mechanism for rotating the drive member about the drive axis, and a second drive mechanism for moving the drive member axially along the drive axis. The drilling apparatus also includes a pipe transfer member for transferring pipes between the magazine and the drive head. The pipe transfer member defines a pipe receiving region for receiving a pipe. The pipe transfer member is movable between a first orientation in which the pipe receiving region is located under to the magazine, and a second orientation in which the pipe receiving region is located under the drive axis of the drive head.

30 Claims, 22 Drawing Sheets

PIPE LOADING DEVICE FOR A DIRECTIONAL DRILLING APPARATUS

CROSS REFERENCE TO RELATED APPLICATIONS

The present application is a continuation-in-part of application Ser. No. 09/970,093, filed Oct. 2, 2001, now U.S. Pat. No. 6,533,046, which is a continuation of application Ser. No. 09/321,988, filed May 28, 1999, now issued as U.S. Pat. No. 6,332,502, which applications are herein incorporated by reference.

FIELD OF THE INVENTION

The present invention relates generally to pipe loading devices. More particularly, the present invention relates to pipe loading devices for use with directional drilling machines.

BACKGROUND OF THE INVENTION

Directional drilling machines are used to drill holes along a generally horizontal path beneath the ground. After a hole is drilled, a length of cable or the like can be passed through the hole. Such directional drilling machines eliminate the need for digging a long trench to lay a length of cable or the like.

A typical directional drilling machine includes an elongated track that can be aligned at an inclined orientation relative to the ground. A drive head is mounted on the track so as to be moveable along the length of the track. The drive head includes a drive member that is rotated about a drive axis that is generally parallel to the track. The drive member is adapted for connection to a length of pipe. For example, the drive member can include a threaded end having either female or male threads.

To drill a hole using the directional drilling machine, the track is oriented at an inclined angle relative to the ground, and the drive head is retracted to an upper end of the track. Next, a length of pipe is unloaded from a magazine and is coupled to the drive member of the drive head. Once the pipe is connected to the drive head, the drive head is driven in a downward direction along the inclined track. As the drive head is driven downward, the drive member is concurrently rotated about the drive axis. Typically, a cutting element is mounted at the distal end of the pipe. Consequently, as the drive head is driven down the track, the rotating pipe is pushed into the ground thereby causing the pipe to drill or bore a hole. By stringing multiple pipes together, it is possible to drill holes having relatively long lengths.

After drilling a hole, it is common for a back reamer to be connected to the end of the drill string. Once the back reamer is connected to the end of the drill string, the directional drilling apparatus is used to pull the string of pipes back toward the drilling machine. As the string of pipes is pulled back toward the drilling machine, the reamer enlarges the pre-drilled hole, and the pipes are individually uncoupled from the drill string and loaded back into the magazine of the directional drilling machine.

To enhance drilling productivity, it is important to maximize the efficiency in which pipes can be loaded into and unloaded from the magazine of a directional drilling machine. Until fairly recently, pipes were manually carried between the magazine and the drive head of a drilling machine, and were also manually loaded into and unloaded from the magazine. Recent developments have improved pipe loading and unloading efficiencies through automation.

For example, U.S. Pat. No. 5, 556,253 to Rozendaal et al. (the '253 patent), and U.S. Pat. No. 5,607,280 (the '280 patent) to Rozendaal, disclose improved pipe loading/unloading devices. The '253 and '280 patents disclose devices that effectively use gravity to automatically unload pipes from a magazine. The '253 and '280 patents also disclose devices each having pipe transfer members that automatically move pipes between a magazine and a drive head. The advances provided by the devices disclosed in the '253 and '280 patents have assisted in significantly improving a drill operator's ability to enhance drilling productivity.

SUMMARY OF THE INVENTION

One aspect of the present invention relates to a drilling apparatus including a magazine for holding a plurality of pipes, and a drive head having a drive member adapted to be coupled to a pipe. The drive member is aligned along a drive axis. The drilling apparatus also includes a first drive mechanism for rotating the drive member about the drive axis, and a second drive mechanism for moving the drive member axially along the drive axis. The drilling apparatus is provided with a pipe transfer member for transferring pipes between the magazine and the drive head. The pipe transfer member defines a pipe receiving region for receiving or holding a pipe. The pipe transfer member is movable to a position wherein the pipe receiving is positioned beneath the magazine. The drilling apparatus also includes a plurality of independent pipe stops, each of the pipe stops being positioned adjacent to one of a plurality of vertical columns of the magazine.

Another aspect of the present invention relates to a method of drilling including storing a plurality of pipes in a magazine and positioning a pipe transfer member under a selected column of the magazine. Each of the columns of the magazine includes independent pipe stops. A pipe lift is raised and a pipe is released from the selected column. The pipe lift lowers is then lowered and transfers the pipe to the pipe transfer member. Yet another aspect of the present invention relates to a method of returning a pipe to a selected column.

A variety of advantages of the present disclosure will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of this specification, illustrate various aspects of the invention and together with the description, serve to explain the principles of the invention. A brief description of the drawings is as follows.

DETAILED DESCRIPTION

Reference will now be made in detail to exemplary aspects of the present invention which are illustrated in the accompanying drawings. Wherever possible, the same reference numbers will be used throughout the drawings to refer to the same or like parts.

I. General Description

Figure 1:
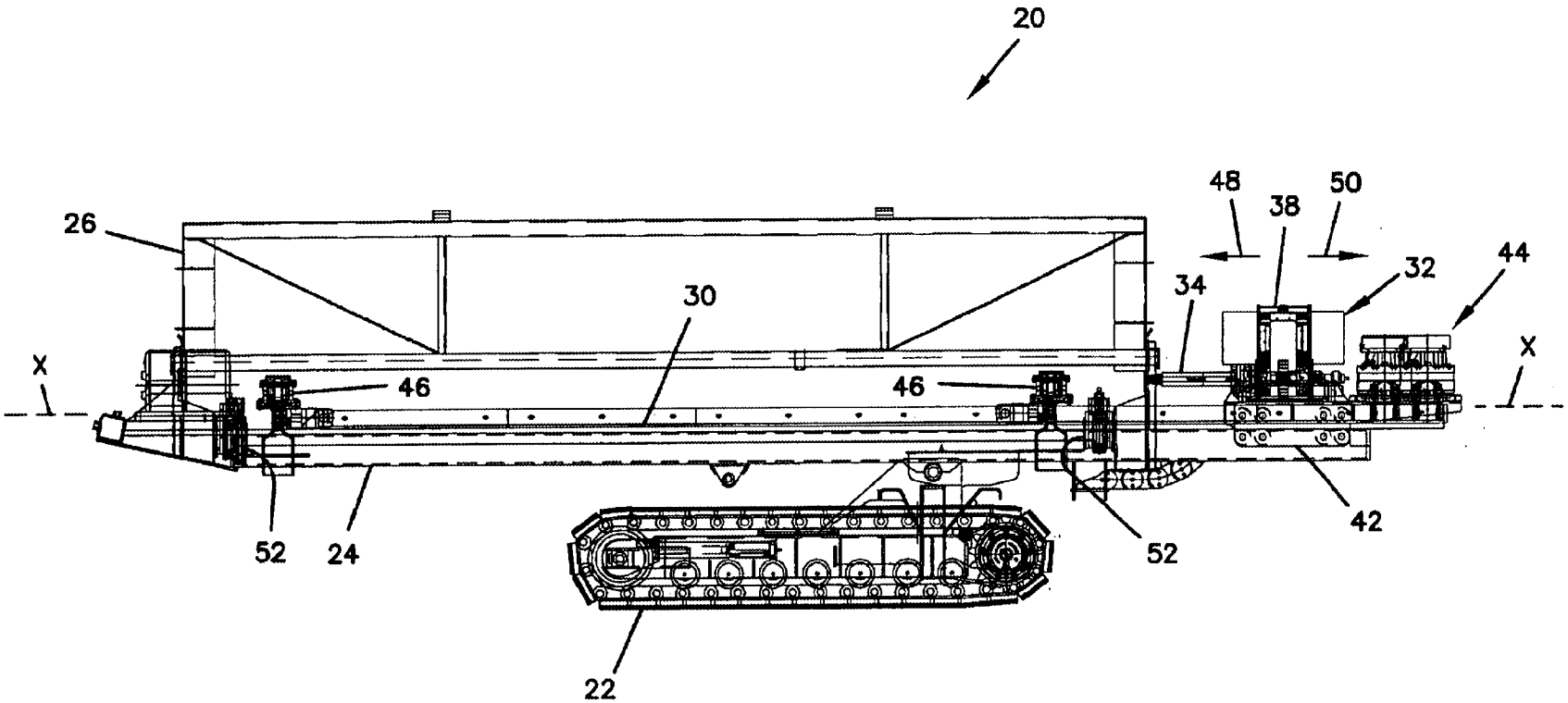
FIG. 1 is a side elevational view of a directional drilling or boring machine constructed in accordance with the principles of the present invention.

FIG. 1 shows a drilling apparatus 20 (e.g., a directional boring machine) constructed in accordance with the principles of the present invention. The drilling apparatus 20 includes a pair of drive tracks 22 (only one shown) for propelling the drilling apparatus 20 along the ground. A frame 24 is pivotally mounted above the drive tracks 22. A magazine 26 for holding a plurality of pipes is supported on the frame 24. An elongated track 30 is also supported on the frame 24. A drive head 32 is mounted on a carriage 42 that is coupled to the elongated track 30. The drive head 32 includes a drive member 34 adapted to be coupled to a pipe (e.g., the drive member 34 includes a threaded end 36 that can be threaded within a pipe). A drive mechanism 38 is provided for rotating the drive member 34 about a longitudinal drive axis X—X that is generally parallel with respect to the elongated track 30, and a drive mechanism 44 is provided for moving the carriage 42 back and forth along the elongated track 30. A pair of pipe transfer members 46 are used to convey pipes between the magazine 26 and the drive head 32.

The drilling apparatus 20 is used to push a drill string of pipes into the ground to bore a hole. To start the drilling sequence, the frame 24 is pivoted relative to the drive tracks 22 such that the elongated track 30 is inclined relative to the ground. Also, the carriage 42 is moved to a start position as shown in FIG. 1. A first pipe is then removed from the magazine 26 by the pipe transfer members 46 and placed in coaxial alignment with the drive axis X—X of the drive head 32. With the pipe aligned along the drive axis X—X, one end of the pipe is coupled to the drive member 34 of the drive head 32. Preferably, a cutting member (e.g., a drill head) is positioned at the other end of the pipe. Once the pipe has been coupled to the drive member 34, the drive mechanism 38 is used to rotate the pipe about the drive axis X—X. Concurrently, a push stroke is initiated such that the rotating pipe is drilled into the ground. During the push stroke, the drive mechanism 44 moves the carriage 42 in a direction 48 along the track 30. As is conventionally known in the art, drilling fluids can be used to facilitate drilling operations.

After the push stoke has been completed, the drive member 34 of the drive head 32 is uncoupled from the pipe and a return/pull stroke is initiated such that the carriage 42 returns to the start position of FIG. 1. During the return/pull stroke, the drive mechanism 44 moves the carriage 42 in a direction 50 along the track 30. With the carriage 42 returned to the start position, a second pipe is removed from the magazine 26 and placed in coaxial alignment with the drive axis X—X. As so aligned, the second pipe is coupled to both the drive member 34 and the first pipe to form a drill string. Thereafter, a push stroke is again initiated such that the entire drill string is pushed further into the ground. By repeating the above steps, additional pipes can be added to the drill string thereby increasing the length of the hole that is being drilled by the drilling apparatus.

Once the hole has been drilled to a desired length, it is common to enlarge the hole through a back reaming process. For example, a back reamer can be attached to the distal end of the drill string. Additionally, product desired to be placed in the hole (e.g., a cable, a duct or the like) can also be connected to the distal end of the drill string. The drill string is then rotated and pulled back toward the drilling apparatus by the drive head 32. For example, the drive head 32 is connected to the drill string and then a return/pull stroke is initiated causing drill string to be pulled in the direction 50. As the drill string is pulled back to the drilling apparatus 20, the back reamer enlarges the previously drilled hole and the product is pulled into the enlarged hole. With each pull/return stroke of the drive head 32, a pipe is removed from the ground. A conventional scraper (not shown) can be used to remove earth residue from the pipes as the pipes are extracted. The extracted pipes are then uncoupled from the drill string and the pipe transfer members 46 are used to convey the pipes back to the magazine 26. Preferably, pipe lifts 52 are used to push the pipes from the pipe transfer members 46 back into the magazine 26.

An important aspect of the present invention relates to a holding structure (i.e., a pipe grip) for holding the pipes on the pipe transfer members 46. In this regard, a pipe attracting structure (e.g., a magnet or vacuum head) capable of attracting a pipe toward a gripping surface is preferably used. The gripping surface, via the attractive force provided the pipe attracting structure, holds, aligns, grasps, grips or otherwise retains the pipe at a desired location on the pipe transfer members. The phrase "gripping surface" is intended to include or mean any surface against which a pipe can be held by an attractive force such as a magnetic force or a suction force. Because the pipe attracting structure attracts the pipe toward the gripping surface, the gripping surface need only engage one side of the pipe to hold the pipe. Therefore, unloading of pipes from the pipe transfer members 46 is facilitated. Similarly, loading of pipes to the pipe transfer members is also facilitated.

II. The Magazine

Figure 2:
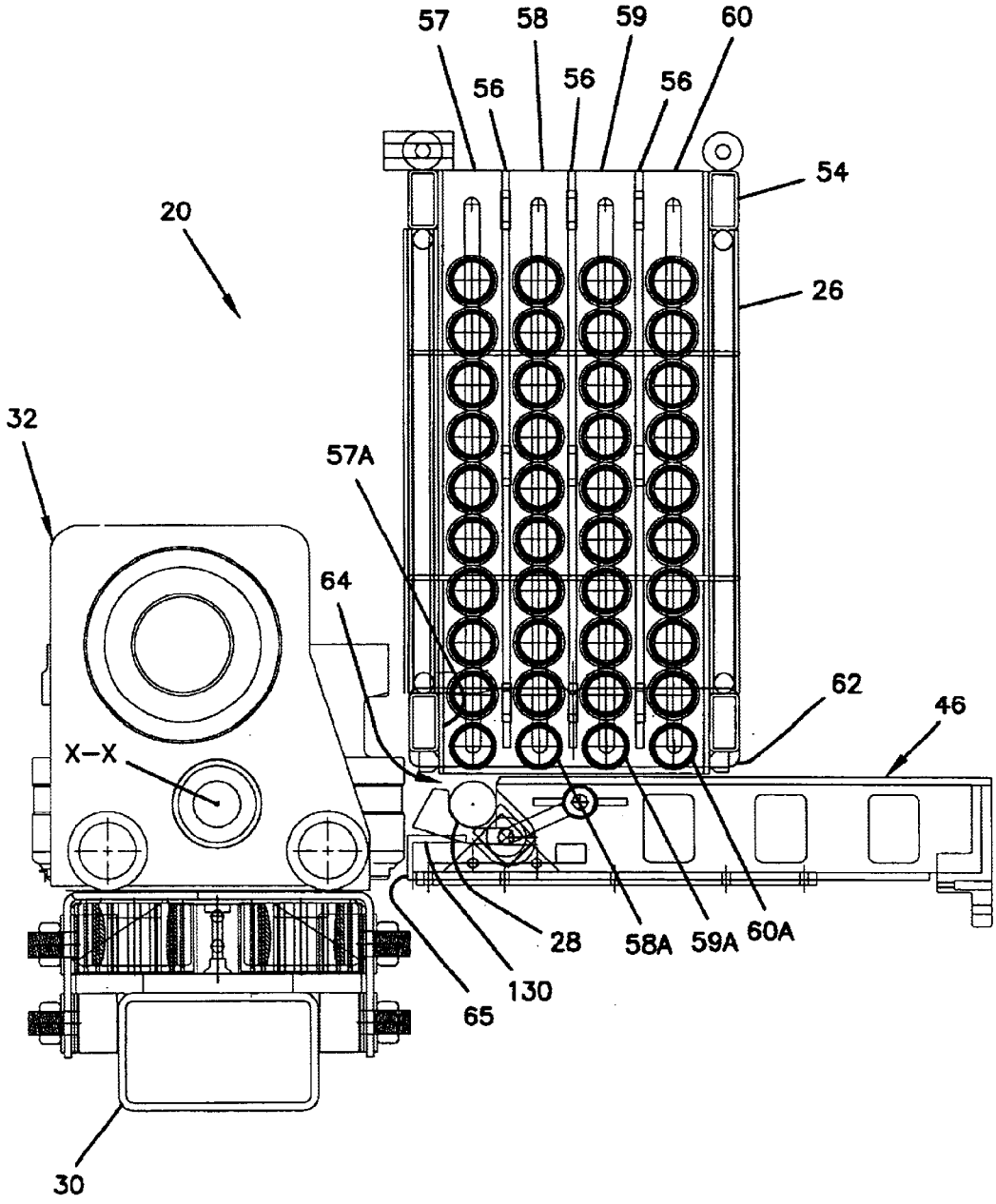
FIG. 2 is an end elevational view of the machine of FIG. 1, a pipe transfer member of the machine is shown in a retracted orientation.
Figure 3:
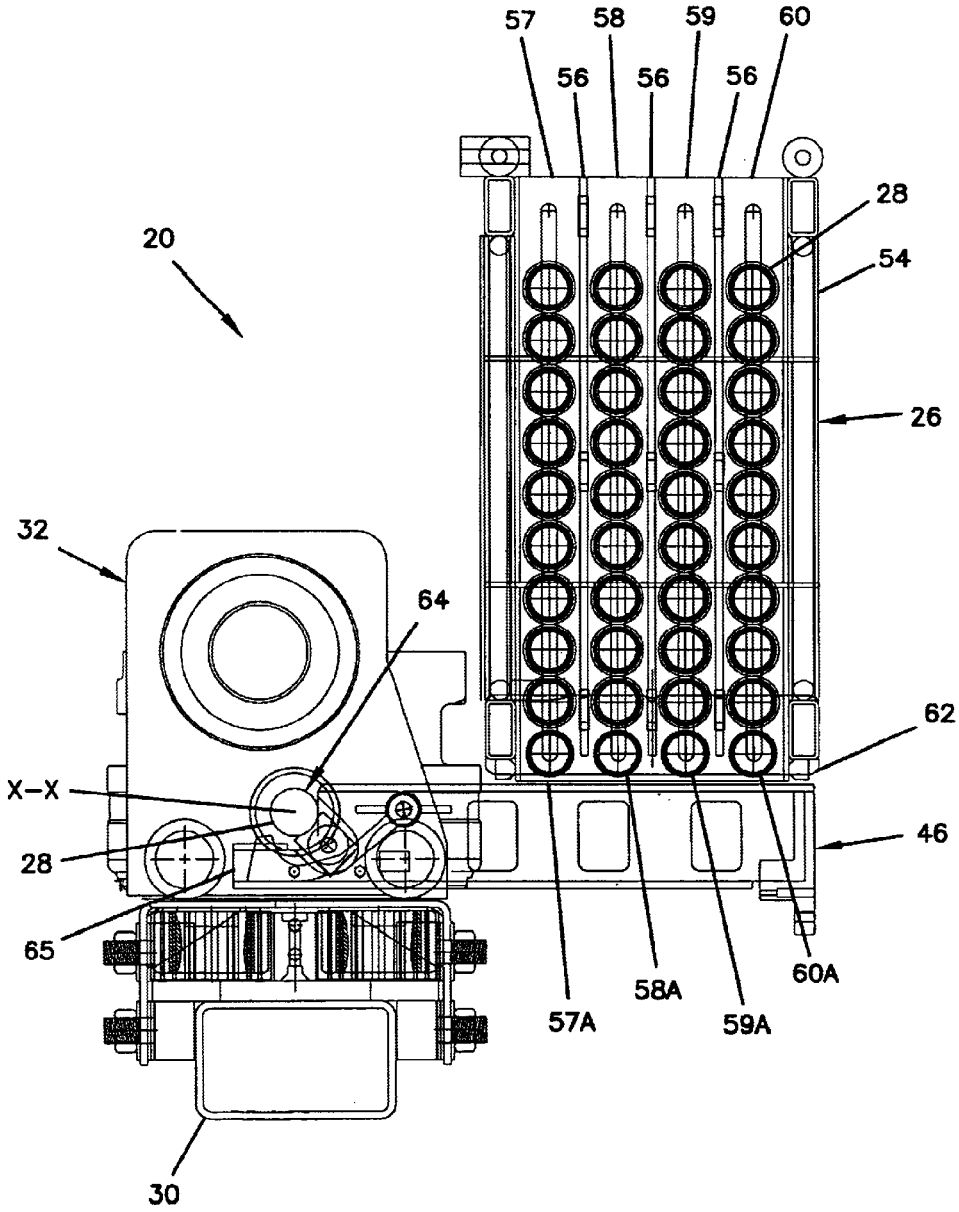
FIG. 3 is an end elevational view of the machine of FIG. 1 with the pipe transfer member in an extended orientation.

Referring to FIGS. 2 and 3, the magazine 26 of the drilling apparatus 20 includes a box-shaped frame 54 having a plurality of dividing walls 56. The walls 56 divide the magazine 26 into a plurality of columns 57–60. The column 57 nearest the drive head 32 is referred to as a first column. The column 60 farthest from the drive head 32 is referred to as an end column. Each of the columns 57–60 is shown containing a plurality of pipes 28 with the pipes aligned vertically within each of the columns 57–60 and with the pipes axes parallel to the drive axis X—X of the drive head 32. The columns 57–60 are each provided with a width approximately equal to the width of one of the pipes 28.

Referring again to FIGS. 2 and 3, the magazine 26 has a bottom end 62 that is open such that the spaces between the dividing walls 56 define a plurality of discharge openings 57A–60A. In a preferred embodiment, the pipes 28 are gravity discharged through the openings 57A–60A.

In the example shown, the magazine 26 has four columns each containing ten pipes. It will be appreciated that the magazine 26 can be provided with more or fewer columns and with more or fewer pipes per column. Also, the magazine can be configured such that the columns are adapted to discharge pipes through a single discharge opening. Consequently, separate discharge openings are not required for each column. Additionally, the magazine can be configured to define a single open bin for holding pipes, and one or more discharge openings for allowing pipes to be removed from the bin. Furthermore, non-gravity feed magazines can also be used.

III. The Pipe Transfer Members

As described above, the transfer members 46 are used to convey pipes between the magazine 26 and the drive head 32. The pipe transfer members 46 each have substantially identical configurations and are simultaneously moved between a retracted orientation (shown in FIG. 2) and an extended orientation (shown in FIG. 3).

Referring to FIGS. 2–5, one of the pipe transfer members 46 is shown. The illustrated pipe transfer member 46 includes a pipe receiving region 64 positioned at an end 65 of the pipe transfer member that is closest to the drive head 32. When the pipe transfer member 46 is in the retracted orientation of FIG. 2, the pipe receiving region 64 is preferably located beneath the magazine 26 (e.g., directly beneath a selected one of the magazine discharge openings 57A–60A). By contrast, when the pipe transfer member 46 is in the extended orientation of FIG. 3, the pipe receiving region 64 is positioned at the drive axis X—X of the drive head 32. As so positioned, a pipe held within the pipe receiving region 64 is preferably placed in coaxial alignment with the drive axis X—X.

Figure 4:
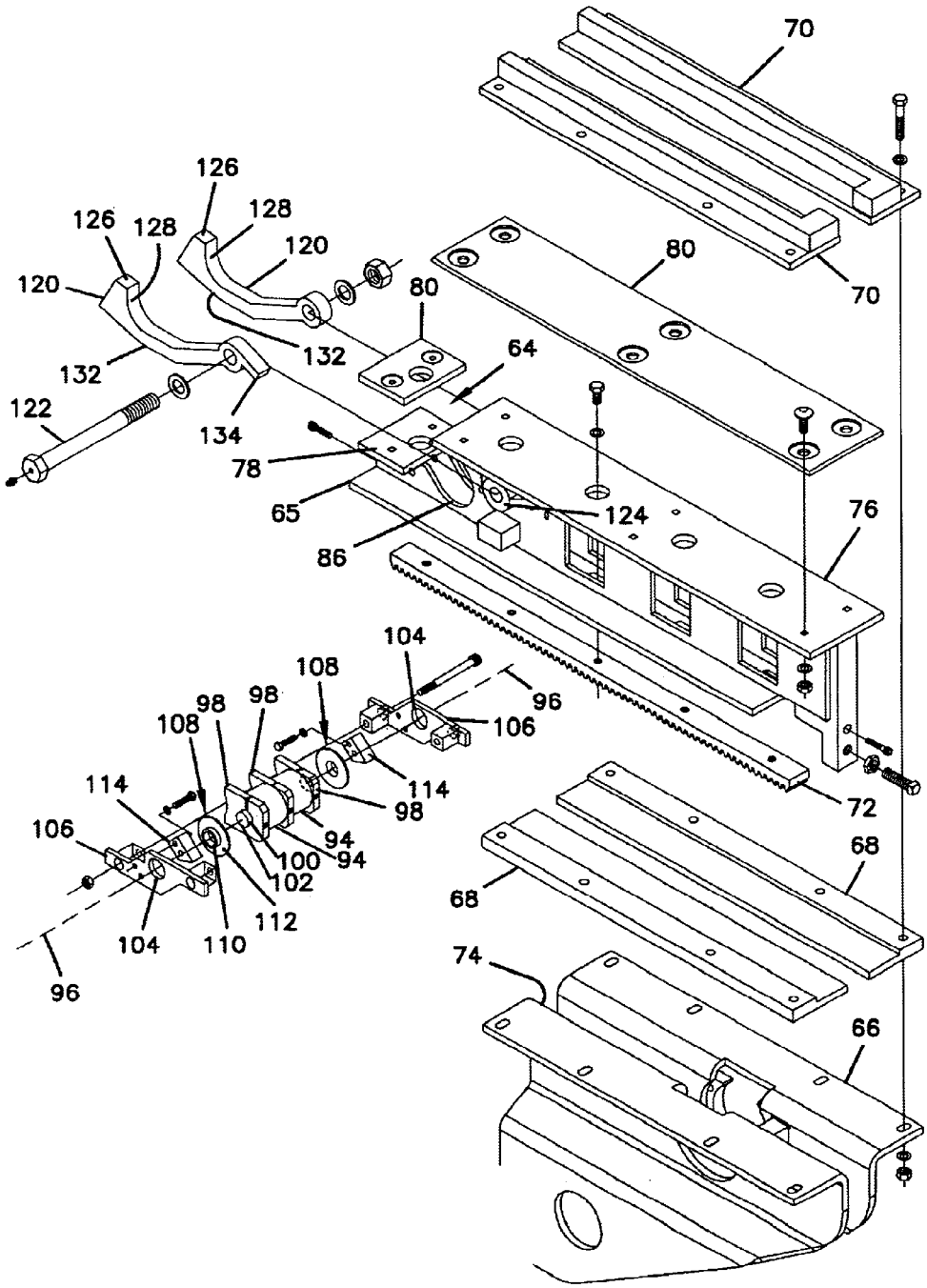
FIG. 4 is an exploded view of one of the pipe transfer members used by the machine of FIG. 1.

As shown in FIG. 4, the pipe transfer member 46 is slidably mounted on a lower track 66. Wear strips 68 (e.g., plastic wear strips) are positioned between the pipe transfer member 46 and the track 66. Cover plates 70 are fastened to the track 66 on opposite sides of the pipe transfer member 46. A gear rack 72 is secured to the bottom of the pipe transfer member 46. The gear rack 72 fits within an elongated slot 74 defined by the track 66. The rack 72 cooperates with a drive gear (not shown), such as a pinion gear driven by a hydraulic motor, to move the pipe transfer member 46 between the extended and retracted orientations.

Referring still to FIG. 4, the pipe transfer member 46 includes a top pipe retaining surface 76 that is used to block the discharge openings 57A–60A. The retaining surface 76 prevents pipes from being discharged from the columns 57–60 when such columns contain pipes, and the pipe receiving region 64 of the pipe transfer member 46 is not positioned below a selected one of the columns 57–60. The pipe transfer member 46 also includes a lower platform 78 that is recessed relative to the pipe retaining surface 76. Both the lower platform 78 and the pipe retaining surface 76 are covered by wear strips 80 preferably made of a suitable plastic-type material.

Figure 5:
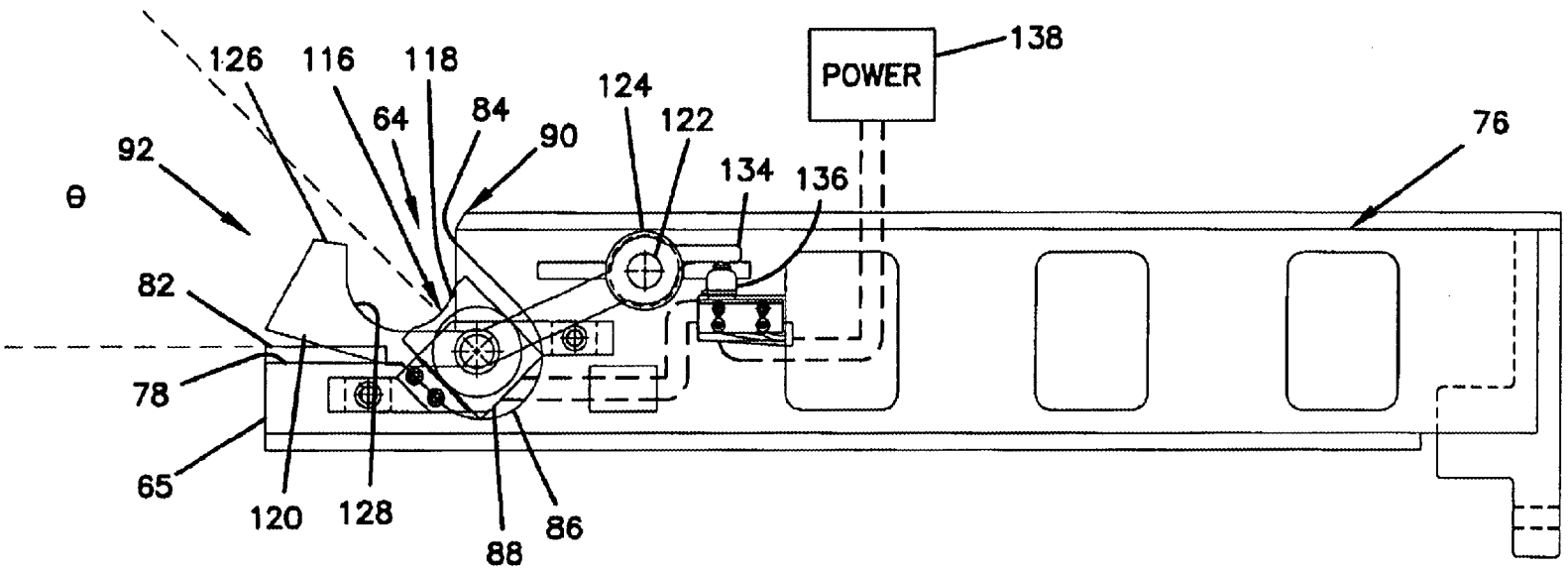
FIG. 5 illustrates the pipe transfer member of FIG. 4 as assembled.

The lower platform 78 is positioned at the end 65 of the pipe transfer member 46 that is closest to the drive head 34. Referring to FIG. 5, the lower platform 78 includes a top surface 82 that is aligned generally along a horizontal plane. The pipe transfer member 46 also includes an upright wall 84 positioned adjacent the pipe receiving region 64. A magnet pocket 86 is positioned at least partially between the upright wall 84 and the lower platform 78. A magnet 88 is mounted within the magnet pocket 86. The lower platform 78, the upright wall 84 and the magnet 88 cooperate to define a partial pocket at the pipe receiving region 64. The partial pocket includes a closed side 90 defined by the magnet 88 and the upright wall 84, and an open side 92 located above the lower platform 78 directly at the end 65 of the pipe transfer member 46 that is closest to the drive head 32.

As shown in FIG. 4, the magnet 88 comprises an electromagnet having two electromagnetic coils 94 aligned along a central axis 96. The magnet 88 also includes three ferromagnetic plates 98 that are axially spaced along the axis 96. The coils 94 are positioned between the plates 98. The magnet 88 further includes a ferromagnetic core or rod 100 that is also aligned along the axis 96. The rod 100 extends through the plates 98 and the coils 94. End portions 102 of the rod 100 are pivotally received within holes 104 defined by magnet mounting brackets 106.

The mounting brackets 106 are used to secure the magnet 88 within the magnet pocket 86 of the pipe transfer member 46. Preferably, the mounting brackets 106 are fastened to the pipe transfer member 46 with the magnet 88 captured within the magnet pocket 86 between the two mounting brackets 106. The pivotal connection between the magnet core 100 and the mounting brackets 106 allows the magnet 88 to float or pivot within the magnet pocket 86 about the axis 96. The pivotal movement of the magnet allows the magnet 88 to self align to better hold a pipe received within the pipe receiving region 64. As shown in FIG. 5, the magnet 88 is preferably mounted at an angel $\theta$ in the range of 35° to 55° relative to horizontal. In a more preferred embodiment, the angle $\theta$ is about 45° relative to horizontal.

To insure adequate magnetic field strength, it is preferred to insulate or isolate the magnet 88 from other metal parts of the pipe transfer member 46. For example, magnetic insulators 108 are provided for insulating the magnet 88 with respect to the mounting brackets 106. The magnetic insulators 108 include cylindrical portions 110 that surround the end portions 102 of the magnetic core 100. The cylindrical portions 110 fit within the holes 104 defined by the mounting brackets 106 thereby insulating the magnetic core 100 from the mounting brackets 106. The magnetic insulators 108 also include washer portions 112 that project radially outward from the cylindrical portions 110 and that insulate the plates 98 from the mounting brackets 106. Additionally, stop members 114 are fastened to the mounting brackets 106 at a location below the magnet 88. The stop members 114 limit the range of pivotal movement of the magnet 88. Additionally, the stop members 114 are preferably made of a dielectric material to further assist in isolating the magnet 88.

Figure 6C:
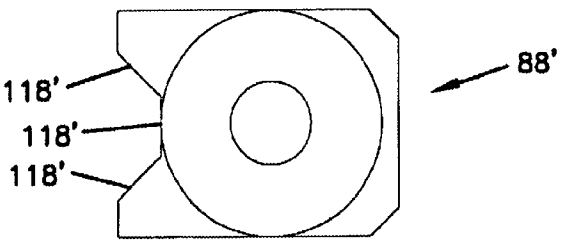
FIG. 6C is a side view of an alternative magnet.
Figure 6B:
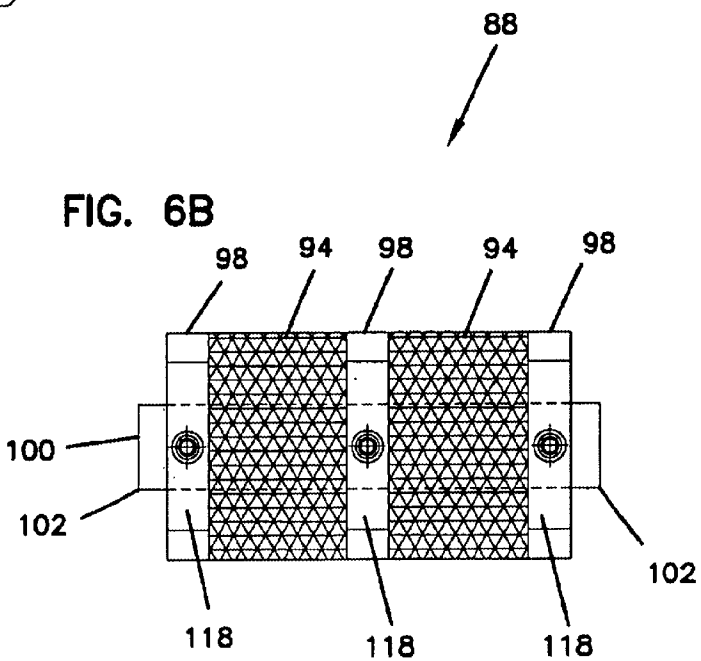
FIG. 6B is a left side view of the magnet of FIG. 6A.
Figure 6A:
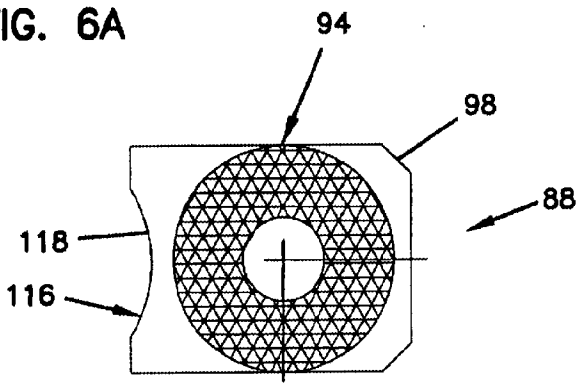
FIG. 6A illustrates a magnet used by the pipe transfer member of FIG. 4.

Referring to FIG. 5, the magnet 88 includes a contoured region 116 that faces outward from the magnet pocket 86 when the magnet 88 is mounted within the pocket 86. The contoured region 116 is preferably contoured to compliment the outer shape of a pipe desired to be handled by the pipe transfer member 46. For example, as shown in FIGS. 6A and 6B, the plates 98 define concave magnetic gripping surfaces 118 adapted to compliment the convex outer surface of a round pipe. When a pipe is placed at the pipe receiving region 64 while the magnet 88 is activated, the pipe is magnetically attracted toward the contoured region 116 of the magnet 88. As the pipe moves toward the magnet 88, the pipe is received and cradled by the concave gripping surfaces 118. Magnetic force provided by the magnet causes the pipe to be magnetically grasped, gripped, held or otherwise retained against the magnetic gripping surfaces 118. The complimentary shape of the gripping surfaces 118 insures that adequate contact is provided between the plates 98 and the pipe. The pivotal nature of the magnet 88 also facilitates providing adequate contact between the plates 98 and the pipe.

Referring again to FIGS. 4 and 5, two assist arms 120 are pivotally connected to the pipe transfer member 46 adjacent to the pipe receiving region 64. The assist arms 120 are connected to opposite sides of the pipe transfer member 46 by a bolt 122 that extends through bosses 124 located on the pipe transfer member 46. The assist arms 120 include upwardly projecting pipe stops 126. Each of the pipe stops 126 includes an inner portion defining a curved surface 128. The assist arms 120 are movable between an upper position (shown in FIGS. 2 and 5) and a lower position (shown in FIG. 3). When the assist arms 120 are in the upper position, the pipe stops 126 block or otherwise obstruct the open side 92 of the partial pocket formed by the pipe transfer member 46. In such a position, the curved surfaces 128 of the assist arms 120 cooperate with the gripping surfaces 118 of the magnet 88 and the upright wall 84 of the pipe transfer member 46 to form a full pocket for receiving and holding a pipe. By contrast, when the assist arms 120 are in the lower position, the pipe stops 126 are positioned completely below a pipe held by the magnet 88 such that the open side 92 of the partial pocket is not obstructed (i.e., the pipe can be horizontally or laterally removed from or inserted into the partial pocket).

The assist arms 120 move to the upper position when the pipe transfer member 46 is moved to the retracted position. Referring to FIG. 2, fixed ramps 130 (only one shown) are positioned on opposite sides of the pipe transfer member 46. When the pipe transfer member 46 is moved to the retracted position, the assist arms 120 contact the fixed ramps causing the assist arms 120 to be pivoted upward to the upper position of FIG. 2. In such an upper position, the fixed ramps 130 engage planar surfaces 132 on the bottoms of the assist arms 120 to prevent the assist arms 120 from pivoting downward while the pipe receiving region 64 of the pipe transfer member 46 is located beneath the magazine 26. The fixed ramps 130 terminate at an outer edge of the magazine 26. As the pipe transfer member 46 is moved from the retracted orientation toward the extended orientation, the assist arms 120 move past the fixed ramps 130 and gravity causes the assist arms 120 to pivot from the upper position to the lower position.

As illustrated in FIGS. 6A and 6B, the gripping surfaces 118 are curved so as to compliment a curved pipe. For pipes having different shapes, (e.g., hexagonal or other polygonal shapes) it is desirable to have gripping surfaces with other than curved contours. For example, FIG. 6C shows a magnet 88' adapted to accommodate a polygonal pipe. The magnet 88' includes a plurality of planar gripping surfaces 118' that are angled relative to one another so as to compliment at least a portion of a polygonal pipe desired to be handled by the pipe transfer member 46. As used herein, the term "pipe" is intended to include any type of structure used in drill strings (e.g., pipes, rods, etc.) having any type of cross-sectional configuration (e.g., round, polygonal, hexagonal).

While in certain embodiments, exclusively the magnet 88 can be used for retaining a pipe at the pipe receiving region 64, the use of the assist arms 120 in combination with the magnet 88 provides numerous advantages. For example, when a pipe is being loaded from a column of the magazine 28 to the pipe receiving region 64, the weight of the stacked pipes can cause the pipe being loaded to be forced away from the magnet 88. To overcome this force, a relatively large magnet would be required. However, by using the assist arms 120 in combination with the magnet 88, a smaller magnet can be used. Additionally, when the magnet 88 is positioned beneath the magazine 26, the magnet is attracted to the metal of the magazine 28 thereby possibly interfering with the smooth movement of the pipe transfer member 46. By using the assist arms 120, the magnet 88 can be de-activated when the pipe receiving region 64 is beneath the magazine 26 thereby eliminating this possible problem.

Referring to FIG. 5, one of the assist arms 120 includes a lever 134 positioned above a switch 136. The switch 136 is electrically connected to a source of electricity 138 (e.g., a 12 volt, 3 amp power source) and is also electrically connected to the electromagnetic coils 94 of the magnet 88. When the assist arm 120 is in the upper position of FIG. 5, the lever 134 holds the switch 136 in a first position in which no electricity is provided to the electromagnetic coils 94. However, when the assist arm 120 pivots to the lower position, the switch 136 moves to a second position in which electricity is provided from the power source 138 to the electromagnetic coils 94. In this manner, the assist arm 120 activates the magnet 88 when the pipe receiving location 64 of the pipe transfer member 46 is moved away from the magazine 26, and deactivates the magnet 88 when the pipe receiving region 64 is moved beneath the magazine 26.

When the pipe transfer member 46 is moved to the extended position, it is preferred to exclusively use the magnet 88 to hold the pipe in alignment with the drive X—X of the drive head 32. With the assist arms 120 pivoted to the lower position, no mechanical members oppose the gripping surfaces of the magnet 88. This is advantageous because it allows the pipe transfer member 46 to be retracted immediately after the pipe has been coupled to the drive member 34 of the drive head 32. In other words, it is not necessary to first move an opposing pipe stop out of the way before retracting the pipe transfer member 46. Also, no additional lift mechanisms are needed to lift the pipe from the partial pocket prior to retraction of the pipe transfer member 46.

While the magnet 88 is preferably an electromagnet, it will be appreciated that in alternate embodiments other types of magnets (e.g., permanent magnets) could be used.

IV. Magazine Loading and Unloading Operations

To unload a pipe from the first column 57 of the magazine 26, the pipe transfer members 46 are moved to the retracted position such that the pipe receiving regions 64 are located directly beneath the discharge opening 57A. With the pipe transfer members 46 so positioned, the pipe lifts 52 are lowered causing the lower most pipe in the first column 57 to move through the discharge opening 57A into the pipe receiving regions 64. The pipe retaining surfaces 76 of the pipe transfer members 46 prevent any pipes from being discharged through any of the discharge openings 58A–60A. In the retracted position of FIG. 2, the magnets 88 are deactivated and the assist arms 120 are in the upper positions. Consequently, the assist arms 120 retain the loaded pipe at the pipe receiving regions 64 while the pipe receiving regions 64 are located beneath the magazine 26.

After the pipe has been loaded into the pipe receiving regions 64, the pipe transfer members 46 are moved toward the extended orientation. As the pipe receiving regions 64 move from beneath the magazine 26, the assist arms 120 move, via gravity, toward the lower position and the magnets 88 are activated. The activated magnets 88 attract the pipe against gripping surfaces 118. The magnetic attraction provided by the magnets 88 resists lateral movement of the pipe within the partial pockets of the pipe transfer members 46 thereby inhibiting the pipe from falling out of the partial pockets during transfer of the pipe. The magnets 88 also inhibit the pipe from sliding along its axis as the pipe is transferred. For example, during drilling operations, the track 30 and magazine 26 are commonly inclined. Therefore, the pipe has a tendency to slide downward along its axis unless somehow restrained. Friction between the gripping surfaces 118 and the pipe preferably provides sufficient resistance to inhibit the pipe from sliding in an axial direction during transfer of the pipe.

When the pipe transfer members 46 have been fully extended, the gripping surfaces 118 are positioned such that the pipe is held in coaxial alignment with the drive axis X—X of the drive head 32. With the pipe so aligned, the drive member 34 of the drive head 32 can be threaded into the pipe, and the pipe can be drilled into the ground. After the pipe has been coupled to the drive member 34, the pipe transfer members 46 are preferably retracted with sufficient force to overcome the magnetic attraction provided by the magnets 88. Hence, the pipe is disengaged from the magnets 88 and laterally displaced from the pipe receiving regions 64 as the pipe transfer members 46 are retracted. The pipe transfer members 46 are then moved back to the position of FIG. 2 such that another pipe from the first column 57 can be loaded into the pipe receiving regions 64. Before the pipe transfer members 46 are retracted, the pipe lifts 52 can be used to lift the pipes within the magazine 26 to reduce wear of the pipe transfer members 46.

In unloading the magazine 26, the sequence of steps described above are repeated until all of the pipes contained in the first column 57 have been selected. Thereafter, the same procedure is repeated with respect to the second column 58, the third column 59 and the fourth column 60 until all of the pipes from the magazine 26 have been selected.

To load the magazine, the pipe transfer members 46 are extended such that a pipe coupled to the drive member 34 is received in the pipe receiving regions 64. Next, the pipe is uncoupled from the drive member 32 and also uncoupled from the drill string. The uncoupled pipe is magnetically attracted against the magnetic gripping surfaces 118 such that the pipe is magnetically held at the pipe receiving regions 64 of the pipe transfer members 46. With the pipe so held, the pipe transfer members 64 are moved from the extended orientation toward the retracted orientation. As the pipe receiving regions 64 move beneath the magazine 26, the assist arms 120 pivot upward to form a full pocket for holding the pipe, and the magnets 88 are deactivated. The pipe transfer members 46 are then oriented such that the pipe receiving regions 64 are positioned beneath the fourth column 60. Next, the pipe lifts 52 are used to lift the pipe from the pipe receiving regions 64, through the discharge opening 60A and into the fourth column 60. The pipe transfer members 46 are then moved back to the extended orientation to receive another pipe from the drill string, and the pipe lifts 52 are lowered. Thereafter, the sequence is repeated until the fourth column 60 has been filled. After the fourth column 60 has been filled, the same process is repeated with respect to the third column 59, the second column 58 and the first column 57 until the entire magazine has been filled.

It will be appreciated that the loading and unloading sequences will depend upon the particular magazine configuration being used. Consequently, the disclosed unloading and loading cycles are being provided as examples that are not intended to limit the scope of the present invention. For example, in one alternate embodiment, individual, separately actuated pipe stops can be used at each of the discharge openings 57A–60A. An example of this embodiment is shown as FIGS. 11–17.

As shown in FIGS. 11–17, in this embodiment the pipe transfer member does not use a blocking surface. Each column contains a pipe stop 280 that can block the individual column; the pipe stop 280 can be a part of a pipe stop assembly 281. The pipe stop assembly 281 can form a part of the basic drill unit such that the magazine 26 is separable or removeable from the pipe stop assembly 281, or can form a part of the magazine 26 such that the magazine 26 and pipe stop assembly 281 are separable or removeable from the basic drill unit. A release mechanism positionable by the pipe transfer member engages with the pipe lift to release a pipe from a selected column. For such an embodiment, pipes can be loaded into or unloaded from any of the columns 57–60 at any given time. Therefore, any type of loading or unloading sequence can be used (i.e., the columns can be loaded or unloaded in any order or even randomly).

Figure 11:
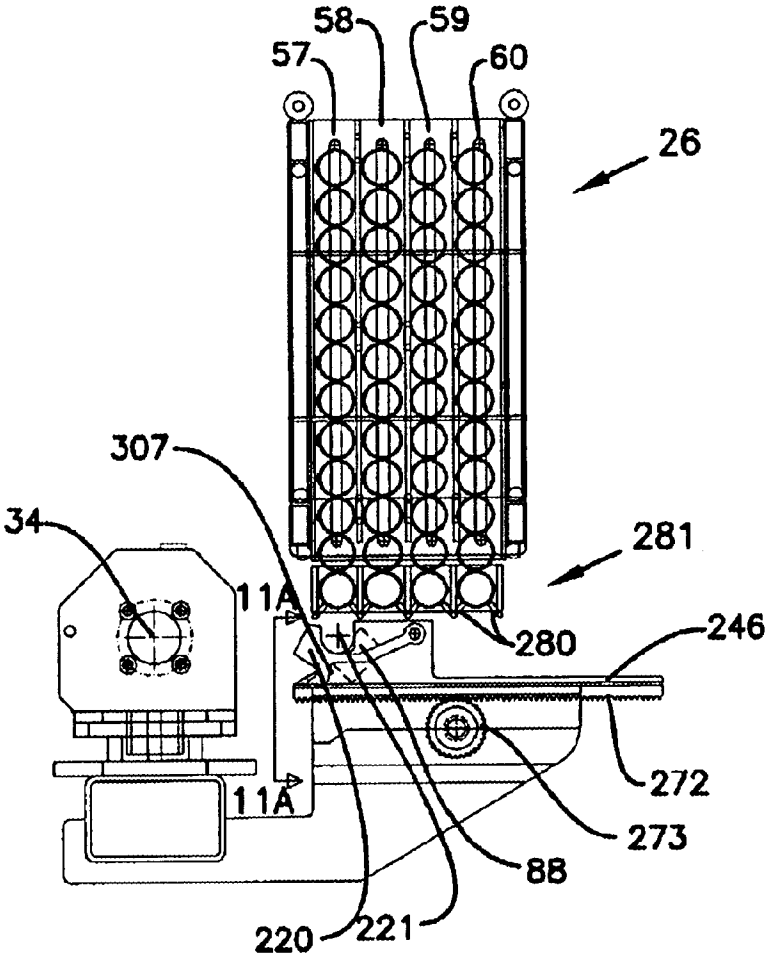
FIG. 11 is a view of an alternate embodiment of a pipe transfer member constructed in a manner to cooperate with a pipe storage magazine including an individual stop for each pipe column.
Figure 11A:
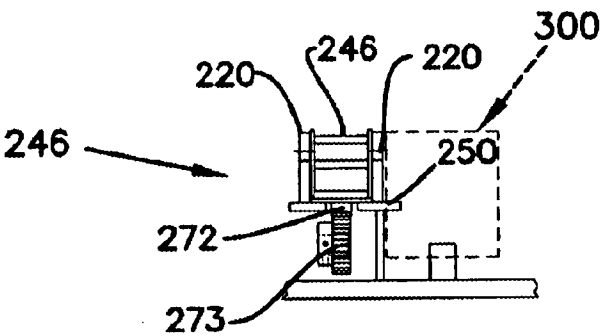
FIG. 11*a* is a partial side view of the pipe transfer member of FIG. 11, from a viewing angle defined along 11A—11A.

Looking in more detail to these figures: FIGS. 11 and 11A illustrate the pipe transfer member 246, including assist arms 220, and magnet 88 which define a pocket 221 to retain a pipe 28. The pipe transfer member 246 further includes a gear rack 272 that will cooperate with a drive gear 273 to move the transfer member between a first position where the pocket aligns with the drive member 34, and a second position or transfer position where the pocket aligns with any one of the columns 57, 58, 59, or 60 in the magazine. Transfer member 246 is supported on a frame surface 250. At the bottom of each of the columns is an independent pipe stop 280 that hold the rods.

In the illustrated embodiment, the pipe stops include first and second arms that rotate to retain or release a pipe. In one embodiment, the pipe stops 80 can be positioned by gravity to retain pipes in the vertical column of the magazine. In another embodiment the pipe stops 280 can be biased, by a spring for example, to a position where pipes are retained within the vertical column. In operation, a release mechanism 300 is used to separately actuate or engage one of the individual pipe stops 280 at a selected vertical column. Preferably, the release mechanism 300 separately actuates or moves a single pipe stop so that a pipe passes through the discharge opening of the vertical column (in either a pipe returning operation or a pipe releasing operation). In the illustrated embodiment, the release mechanism 300 moves the pipe stop to a position wherein the arms of the pipe stop 280 are in a vertical position aligned with each of the walls of the vertical column. When the release mechanism 300 disengages the pipe stop 280, the pipe stop returns to a retaining position to retain the pipes in the vertical column.

Figure 12:
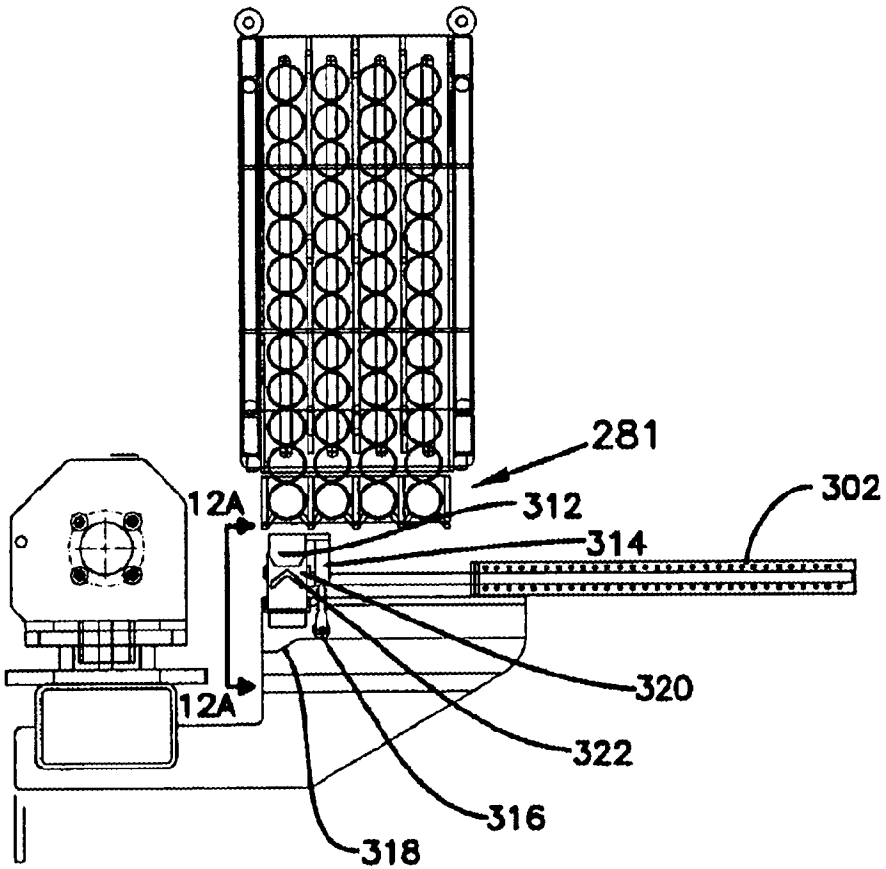
FIG. 12 is a view of a pipe release constructed in a manner to cooperate with a pipe storage magazine including an individual stop for each pipe column in a position to accept a pipe.
Figure 12A:
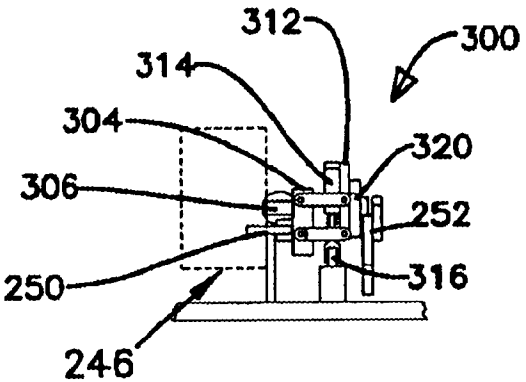
FIG. 12*a* is a partial side view of the pipe release construction of FIG. 12, from a viewing angle defined along 12A—12A.

FIGS. 12 and 12A illustrates one embodiment of the release mechanism 300 including a mount frame 304 which mounts to frame surface 250. The release mechanism 300 is biased toward the drive member 34 by spring 302, and includes a pin 306 that is constructed to cooperate with a surface 307 (FIG. 11) of the assist arm 220 of the transfer member 246. As the transfer member 246 moves between the transfer positions where the pocket 221 is aligned with the rod columns 57, 58, 59 or 60, the release mechanism 300 will remain in alignment with the pocket 221. When the transfer member 246 moves to its first position, in alignment with drive member 34, the release mechanism 300 will stop at a home position, as will be described.

Figure 13:
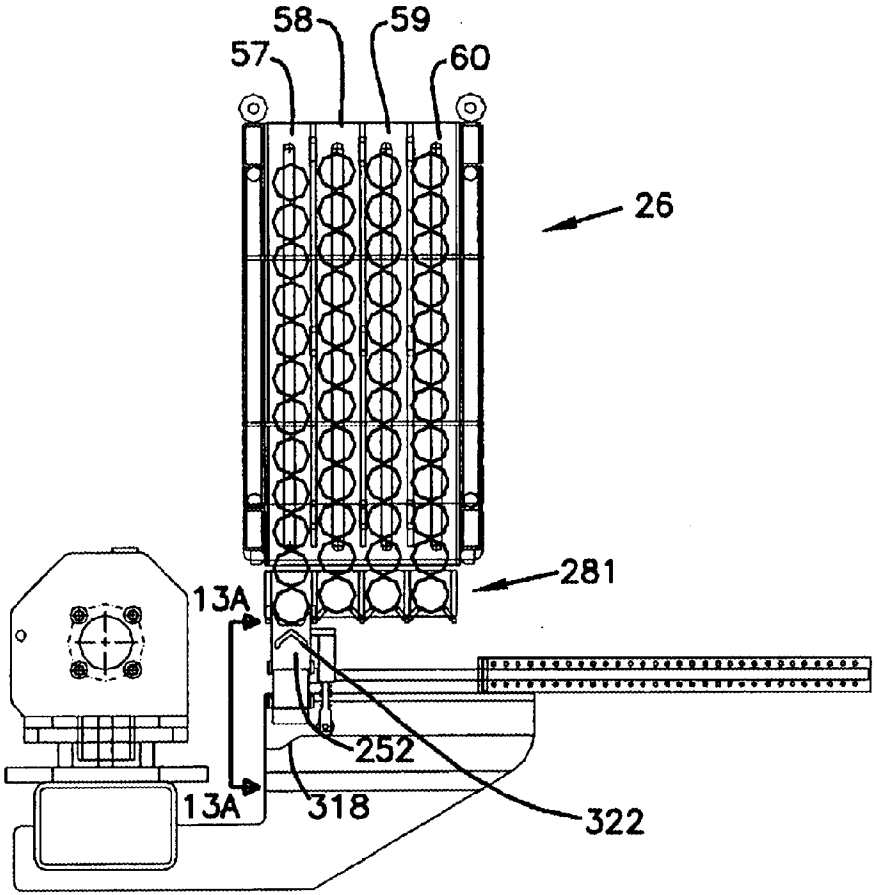
FIG. 13 is a view of a pipe release constructed in a manner to cooperate with a pipe storage magazine including an individual stop for each pipe column in a position where the release member is raised to release a pipe.
Figure 13A:
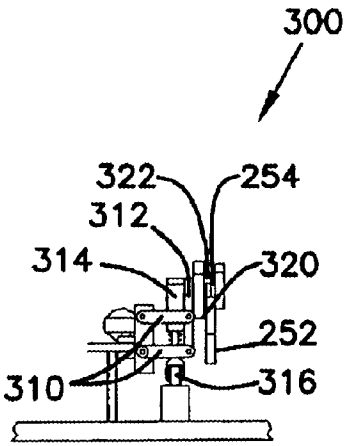
FIG. 13*a* is a partial side view from a viewing angle defined along 13*a*–13*a* as defined in FIG. 13.
Figure 14:
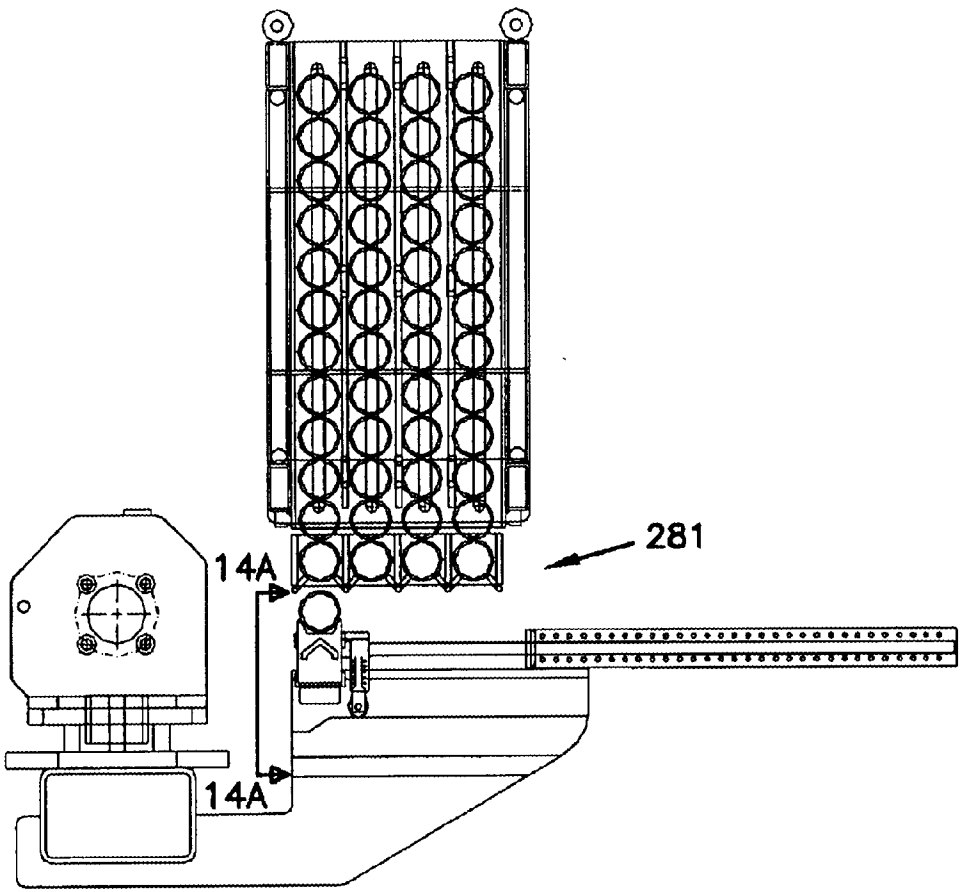
FIG. 14 is a view of a pipe release constructed in a manner to cooperate with a pipe storage magazine including an individual stop for each pipe column in a position to transport a pipe.
Figure 14A:
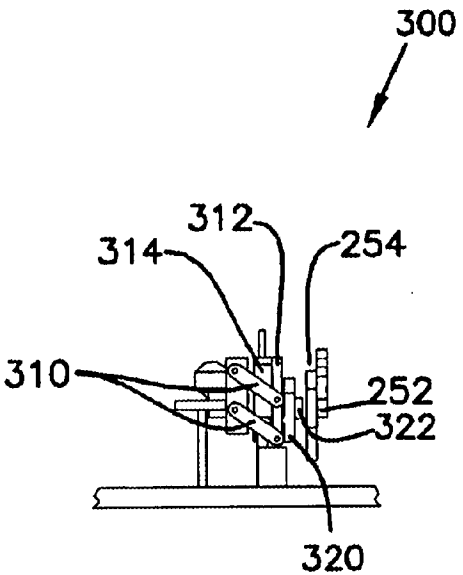
FIG. 14*a* is a partial side view from a viewing angle defined along 14*a*–14*a* as defined in FIG. 14.
Figure 17A:
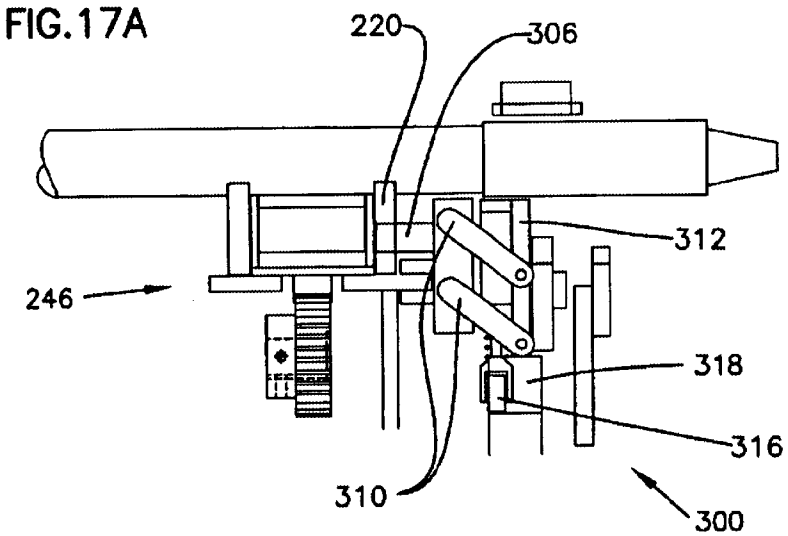
FIGS. 17A–17E are partial side views showing the pipe release, pipe transfer member and pipe lift in positions encountered during process of inserting a pipe into the magazine.

As shown in FIGS. 13A and 14A, the release mechanism 300 further includes a 4-bar linkage 310 that supports a mount plate 312. A spring chamber 314 cooperates with roller 316 to bias the 4-bar link into a raised position, as illustrated in FIG. 12. Roller 316 cooperates with a ramped surface 318 of the frame such that when the transfer member 246 is in its first position, the release mechanism 300 is in the home position, and the 4-bar linkage is lowered. This position is illustrated in FIG. 17A.

Figure 15:
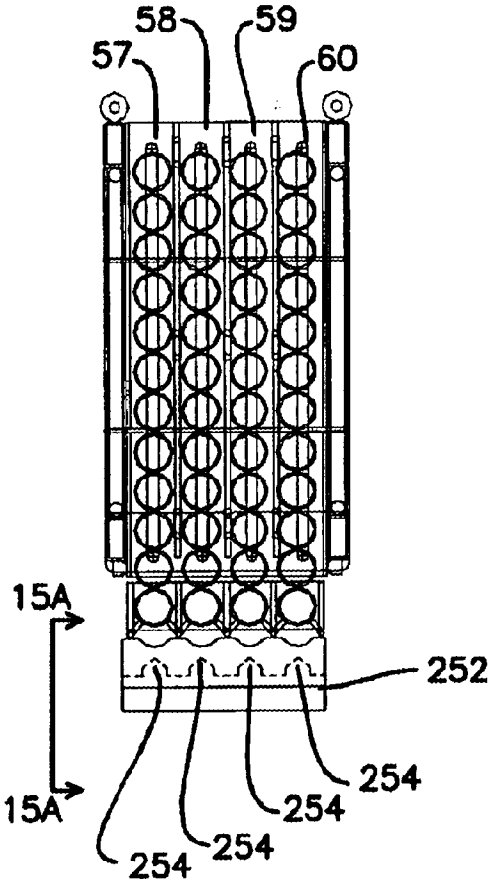
FIGS. 15–15A are views showing a pipe lift configured to cooperate with a pipe release of the present invention.
Figure 15A:
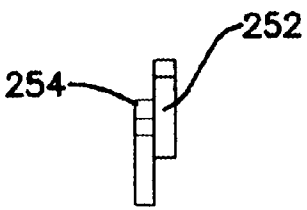

Referring to FIG. 14A, release member 320 is attached to mount plate 312, and includes a tab 322 to cooperate with projection 254 of pipe lift 252. FIG. 15 illustrates the pipe lift, including a projection 254 in alignment with each rod column. FIGS. 13 and 13A illustrate the function of tab 322. In this figure, pipe lift 252 has been raised, and the projection 254 of lift 252 has engaged tab 322, raising release member 320. Release member 320 is shaped to engage the pipe stops 280. In FIG. 13, the release member 320 has been raised by the pipe lift 252 to the point that the pipe stops 280 have been released in column 57, and the column of pipes is supported by pipe lift 252.

FIG. 14 illustrates the configuration resulting when the pipe lift 252 is lowered to move a pipe into pocket 221 of pipe transfer member 246 (FIGS. 12 and 12A). The pipe will contact mount plate 312, compressing the spring chamber 314. This compression will result in a repositioning of the 4-bar link 310 causing the release member 320 to separate from the projection 254 of the pipe lift 252.

Figure 16B:
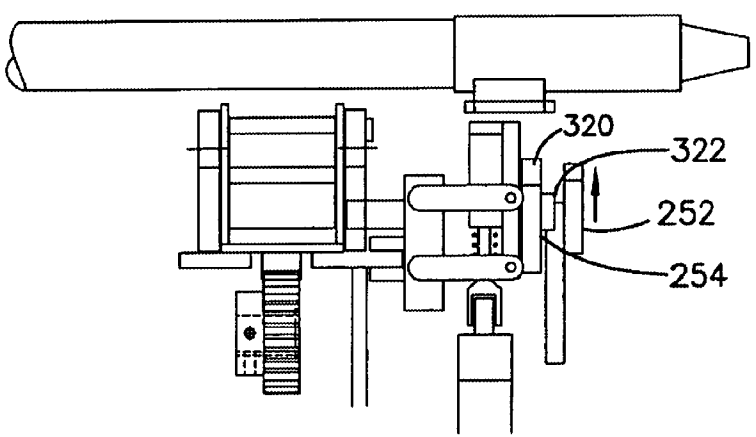
FIGS. 16A–16H are partial side views showing the pipe release, pipe transfer member and pipe lift in positions encountered during process of removing a pipe from the magazine.
Figure 16A:
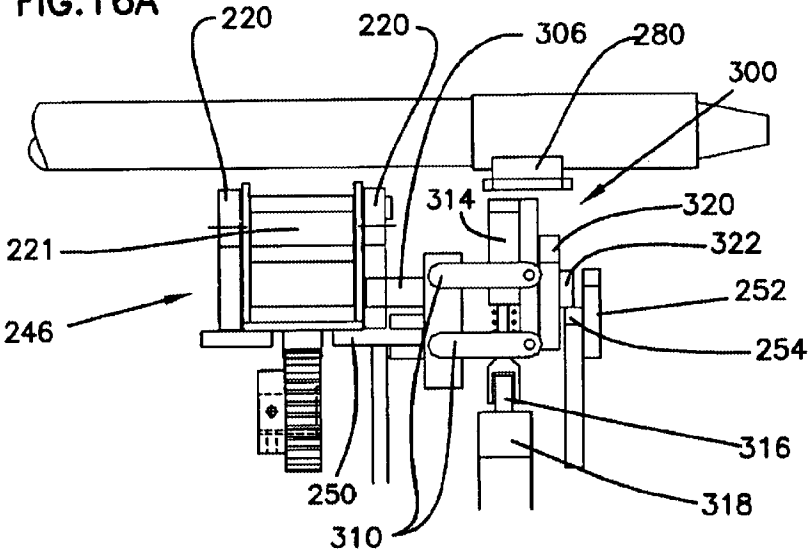

FIGS. 16A–16H illustrate this process in more detail. FIG. 16A illustrates the transfer member 246 positioned at a second position or a transfer position, with the pocket 221 aligned with any one of the columns 57–60. As the transfer member 246 is moves to this position, from the first position, the assist arm 220 contacts the pin 306 of the release mechanism 300, and the two move together to the transfer position. As the release mechanism 300 moves to the transfer position, the release member 320 moves from a non-engagement position to an engagement position. In particular, roller 316 rides up the ramped frame 318 forcing the 4-bar link 310 to rotate up and move the release member 320 into the position shown (in FIG. 16A) to engage with one of the projections 254 of pipe lift 252. In this manner, the pipe release member 320 is positioned under the same column as the pocket 221.

Figure 16C:
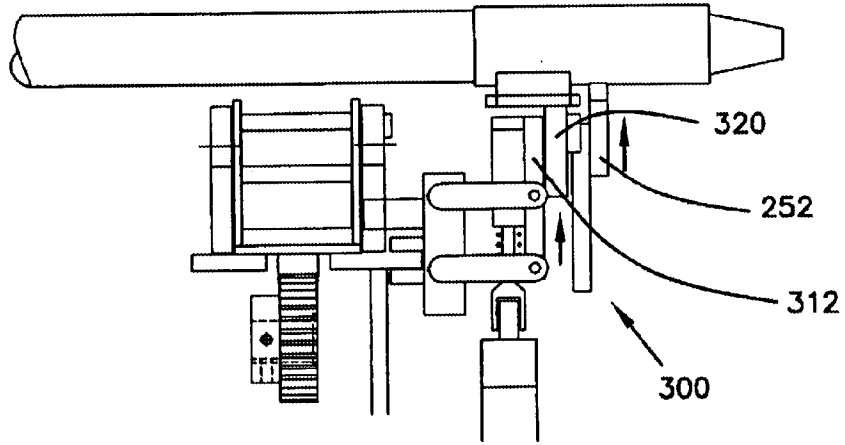
Figure 16D:
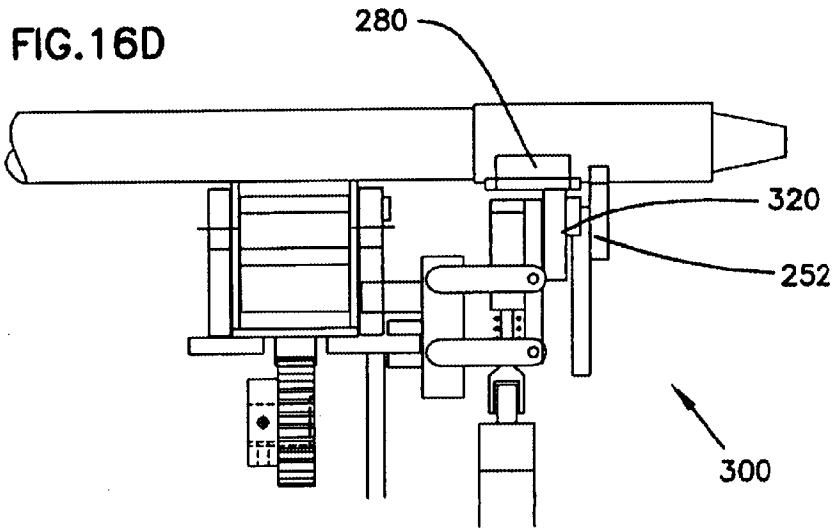

FIG. 16B illustrates the pipe lift 252 as the pipe lift begins to rise. The projection 254 engages with tab 322 of the release member 320. Referring to FIG. 16C, the pipe lift 252 continues to rise towards the pipe column and moves release member 320 from a non-actuating position to an actuating position. In particular, the release member 320 is slidably connected to the mount plate 312 and slides relative to the mount plate 312 as it rises to the actuating position. Referring to FIG. 16D, in the actuating position, release member 320 engages and actuates the pipe stops 280 to release a pipe from the column. In FIG. 16 D, a pipes has dropped down and is being supported by pipe lift 252.

Figure 16E:
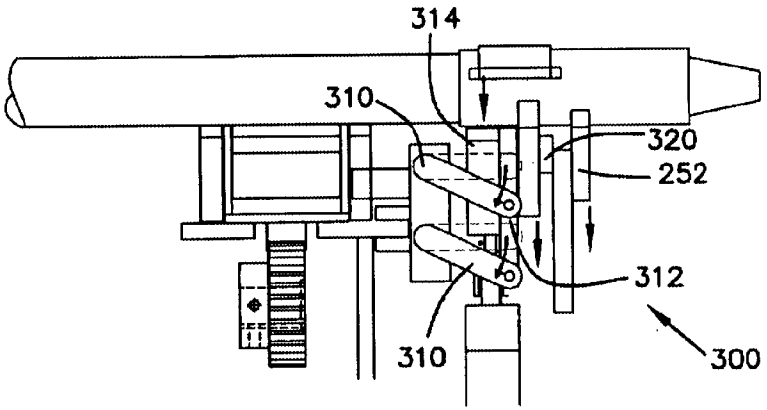
Figure 16F:
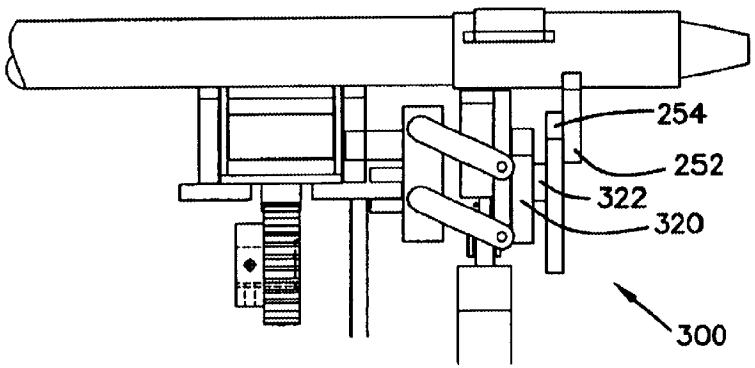
Figure 16G:
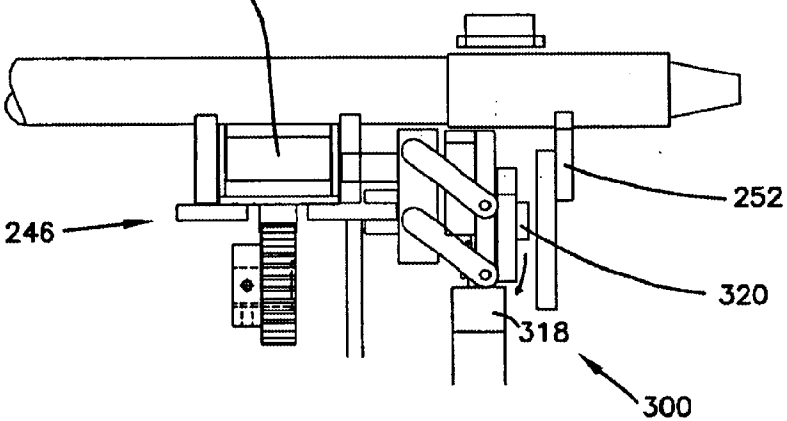
Figure 16H:
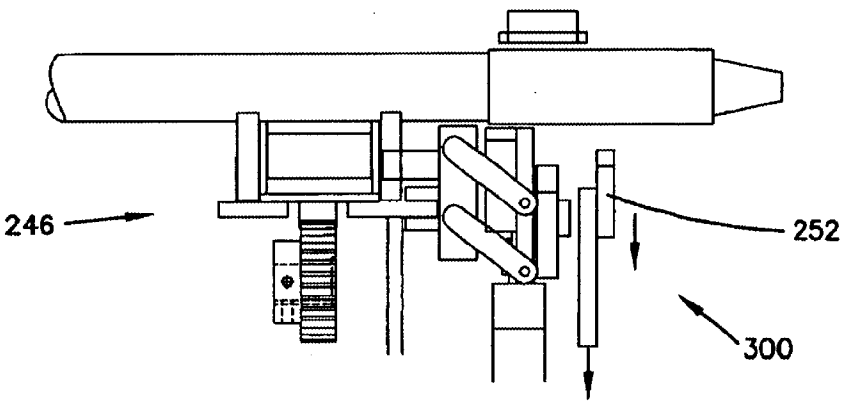

As shown in FIG. 16E, the pipe lift 252 lowers, causing the pipe to contact mount plate 312. The weight of the pipe forces the mount plate 312 to compress the spring chamber 314 and reposition the 4-bar link 310 such that the release member 320 begins to disengage from the pipe lift 252. Referring to FIG. 16F, the tab 322 of the release member 320 disengages, and drops by gravity into the home position. In FIG. 16G, the pipe lift 252 lowers the pipe into pocket 221 of transfer member 246, and as shown in FIG. 16H, the pipe lift 252 lowers to release the pipe. In this position, the pipe is supported by the transfer member 246 and is ready to be transported to the drive member 34.

FIG. 17 illustrate the opposite process, in which a rod is retrieved and installed into a column. FIG. 17A illustrates the position where the transfer member 246 is in its first position aligned with the drill head to retrieve a pipe. When the transfer member 246 is in this position, the release mechanism 300 is in the home position, and the roller 316 has ridden down the ramped surface 318 of the frame, allowing the 4-bar linkage 310 to pivot down.

As the transfer member 246 moves back to one of second transfer positions, the surface 307 (FIG. 11) of the assist arm 220 contacts pin 306. Upon reaching any of the second positions, the release mechanism 300 is repositioned (FIG. 17B) to a point where the roller 316 has ridden up the ramped surface 318, compressed the spring chamber 314, and biased the 4-bar linkage 310. However, as the 4-bar linkage 310 begins to move, mount plate 312 contacts the pipe and prevents further movement of the 4-bar linkage 310. The 4-bar linkage 310 and the mount plate 312 are thus forced to stay in this position while the transfer member 246 moves into a final selected transfer position.

Figure 17B:
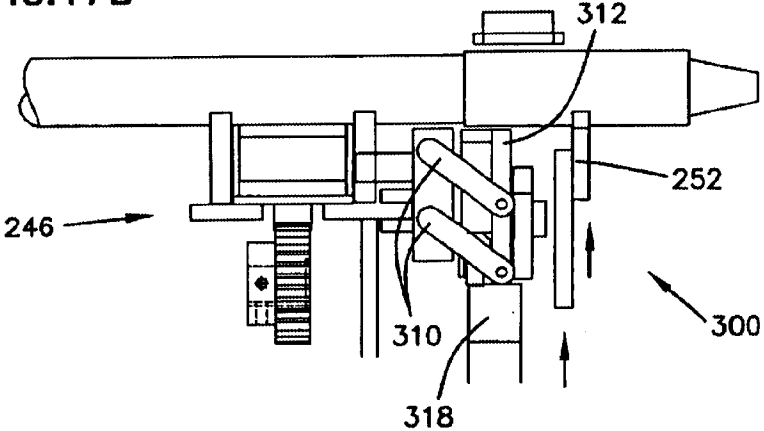
Figure 17D:
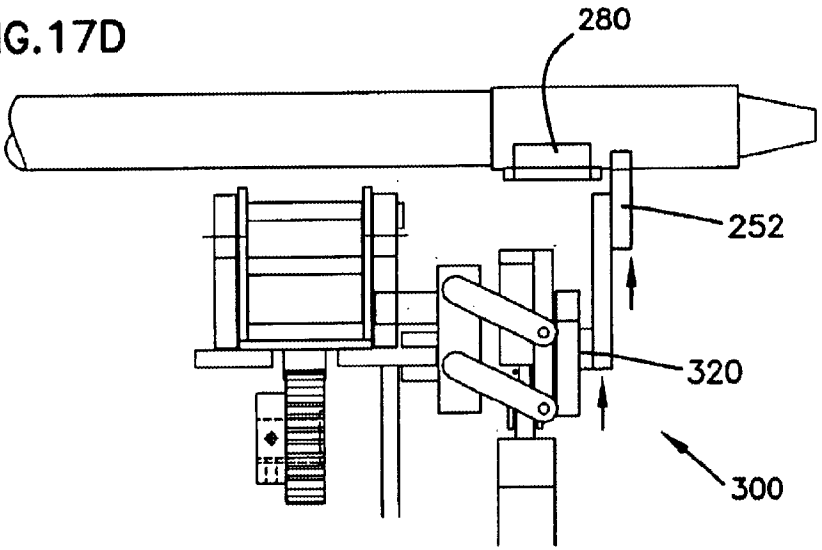
Figure 17C:
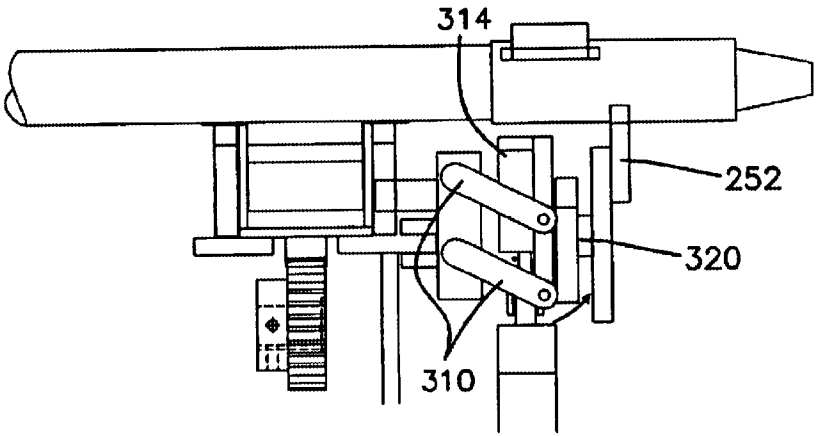
Figure 17E:
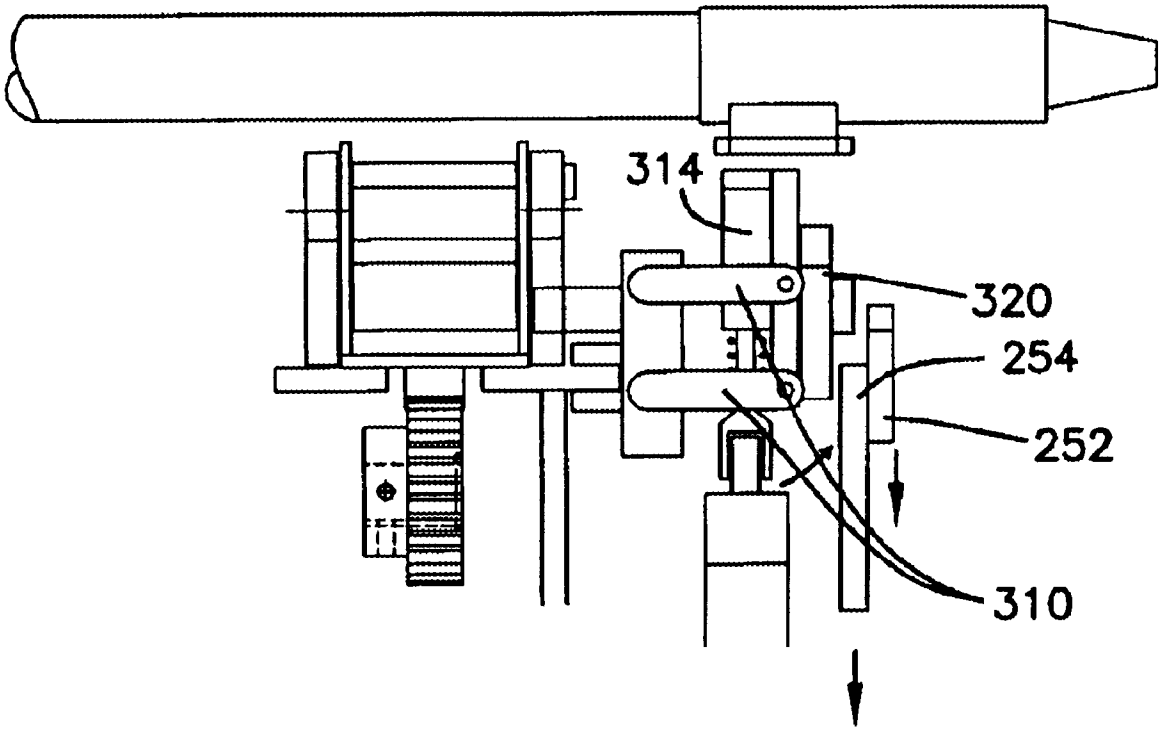

FIG. 17B illustrates the transfer member 246 positioned in alignment with any one of the columns, and the pipe lift 252 being raised to engage a pipe. Referring to FIG. 17C, the pipe lift 252 raises the pipe, and the 4-bar linkage 310 repositions, due to the spring biasing from the spring chamber 314. The 4-bar linkage 310 is biased upward until the release member 320 contacts the pipe lift 252. The 4-bar linkage 310 is blocked from further movement, and the lift 252 moves upwards without release member 320. That is, the release member 320 remains stationary as the pipe lift 252 rises. In FIG. 17D, the pipe lift 252 has fully raised the pipe into the column where the pipe can be supported by the pipe stops 280. Because the release member 320 remains in the lower stationary position, the pipes stops 280 are not actuated by the release member 320 and engage the pipe to retain the pipe in the column. Referring to FIG. 17E, the pipe lift 252 lowers after the pipe has been captured by the pipe stops 280, and the 4-bar link 310, being biased by the spring chamber 314, repositions the release member 320 to the engagement position so that the release member 320 is again aligned with the projections 254 of pipe lift 252.

In summary, the pipe transfer member 246 can be positioned under any one of the pipe columns. If the transfer member 246 is empty, the pipe lift 252 (and the release member 320 which engages the stops 280) can be raised and lowered, resulting in transfer of a pipe from the column to the transfer member 246. If the transfer member 246 holds a pipe as the transfer member 246 is being moved into alignment with a column, the pipe will be moved from the pocket of the transfer member and retained in the column by raising and lowering the pipe lift 252 without the release member 320 (i.e. the release member 320 remains stationary in a lower position). In this manner the transfer member 246 comprises a pocket, with no need for blocking surfaces. The transfer member 246 is able to receive a pipe from any one of the columns, or return a pipe to any one of the columns.

V. Alternative Holding Structure

Figure 7B:
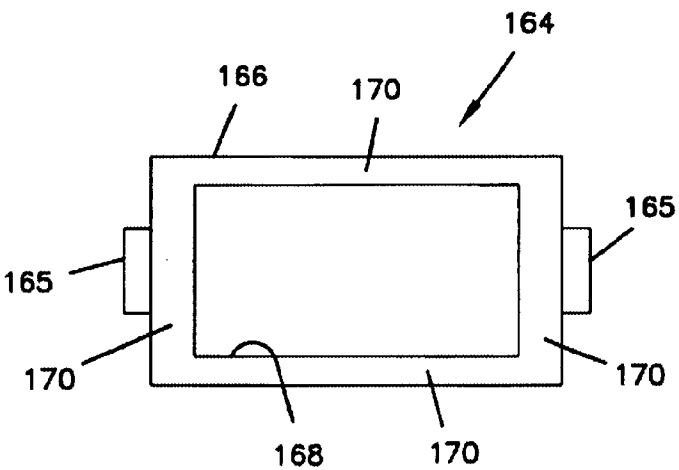
FIG. 7B is a left side view of the pipe holding structure of FIG. 7A.
Figure 7A:
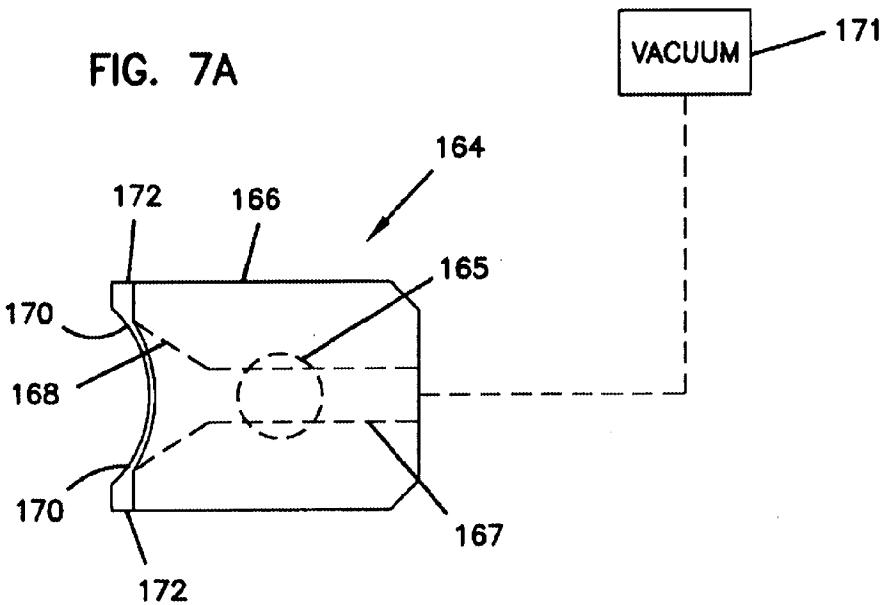
FIG. 7A illustrates an alternative pipe holding mechanism suitable for use with the pipe transfer member of FIGS. 4 and 5.

Referring to FIGS. 7A and 7B, an alternative pipe holding apparatus 164 is illustrated. It will be appreciated that the apparatus 164 is adapted to be mounted in the pocket 86 of the pipe transfer member 46 in a pivotal manner similar to the magnet 88. For example, the apparatus 164 can include pivot members 165 adapted to fit within the holes 104 of the mounting brackets 106.

The holding apparatus 164 includes a vacuum head 166. The vacuum head 166 includes at least one suction opening 168. Pipe gripping surfaces 170 at least partial surround the suction opening 168. The gripping surfaces 170 are preferably contoured so as to compliment an outer surface of a pipe desired to be held. A gasket structure 172 can be provided along the gripping surfaces 170 provide a seal between the vacuum head 168 and a pipe desired to be held.

In use, the vacuum head 166 is preferably mounted in the pocket 86 of the pipe transfer member 46 such that the suction opening 168 faces upward. When a pipe is placed at the pipe receiving region 64, a source of vacuum 171, which is in fluid communication with the suction opening 168, is activated such that the pipe at the pipe receiving region 64 is drawn or attracted toward the suction opening 168. A passageway 167 defined by the vacuum head 166 at least partially provides fluid communication between the suction opening 168 and the source of vacuum 171. Upon being drawn toward the suction opening 168, the pipe is held by suction against the gripping surfaces 170. The gripping surfaces 170 are preferably positioned such that when the pipe transfer member 46 is in the extended orientation, a pipe held against the gripping surfaces 170 is retained in coaxial alignment with the drive axis X—X. If it is desired to release the pipe from the vacuum head 166, the pressure at the suction opening 168 is returned to atmospheric pressure.

VI. Drive Head Assembly

Figure 8:
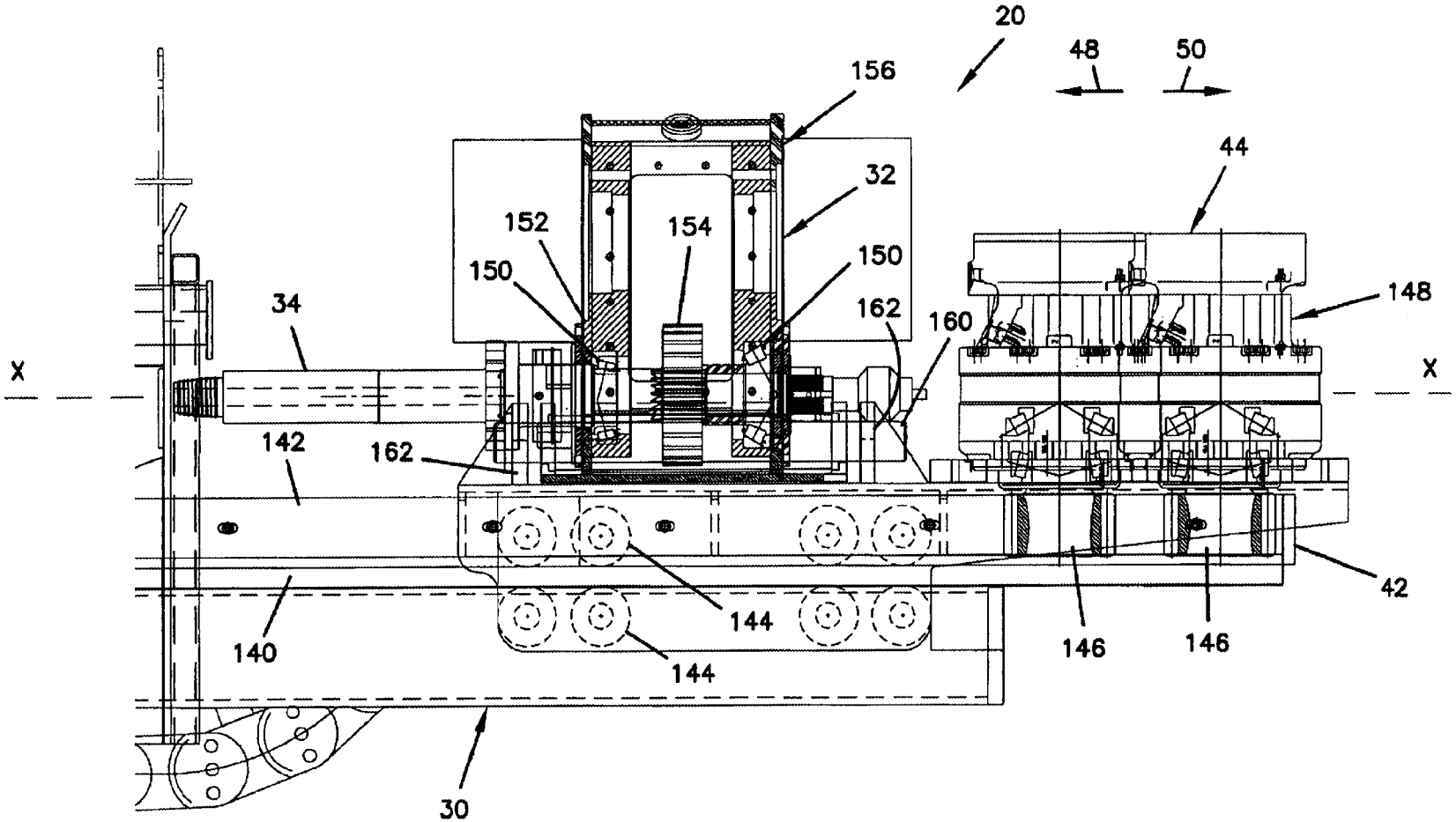
FIG. 8 is an enlarged side view of a drive head of the machine of FIG. 1.
Figure 9:
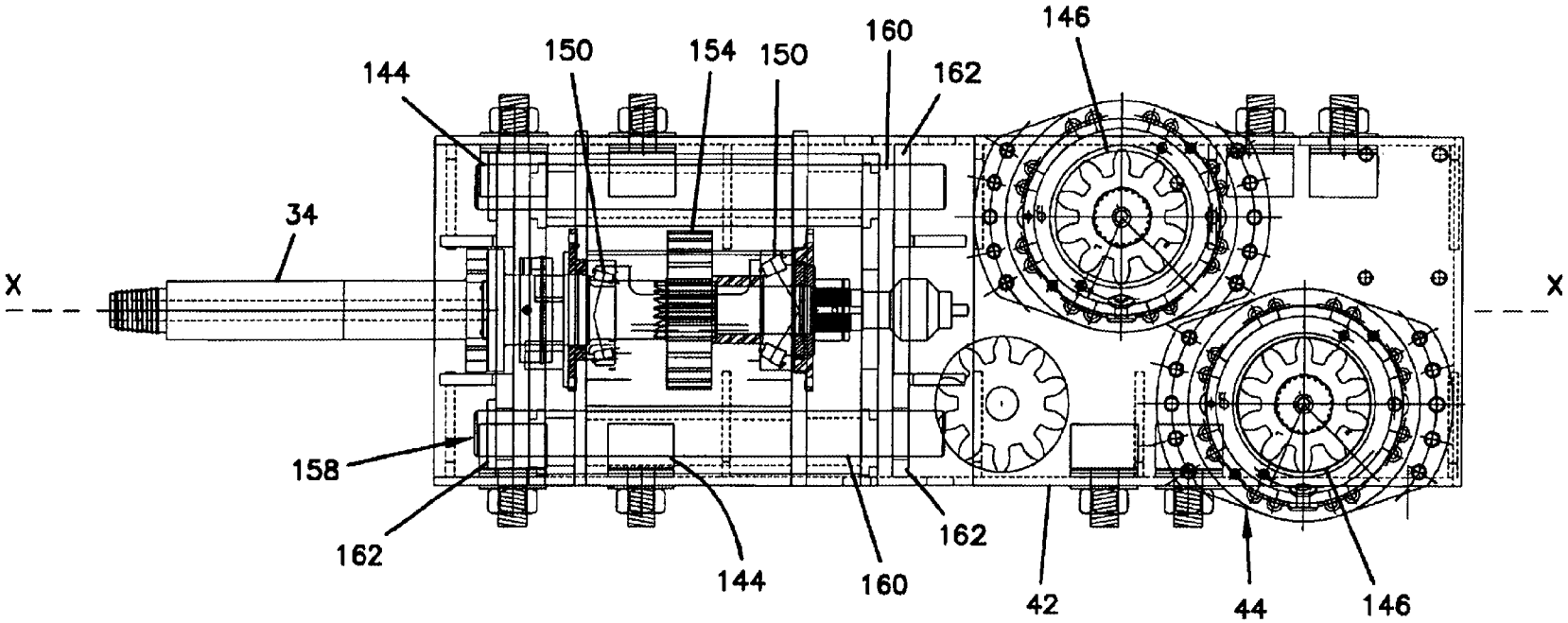
FIG. 9 is a top view of the drive head of FIG. 8.
Figure 10:
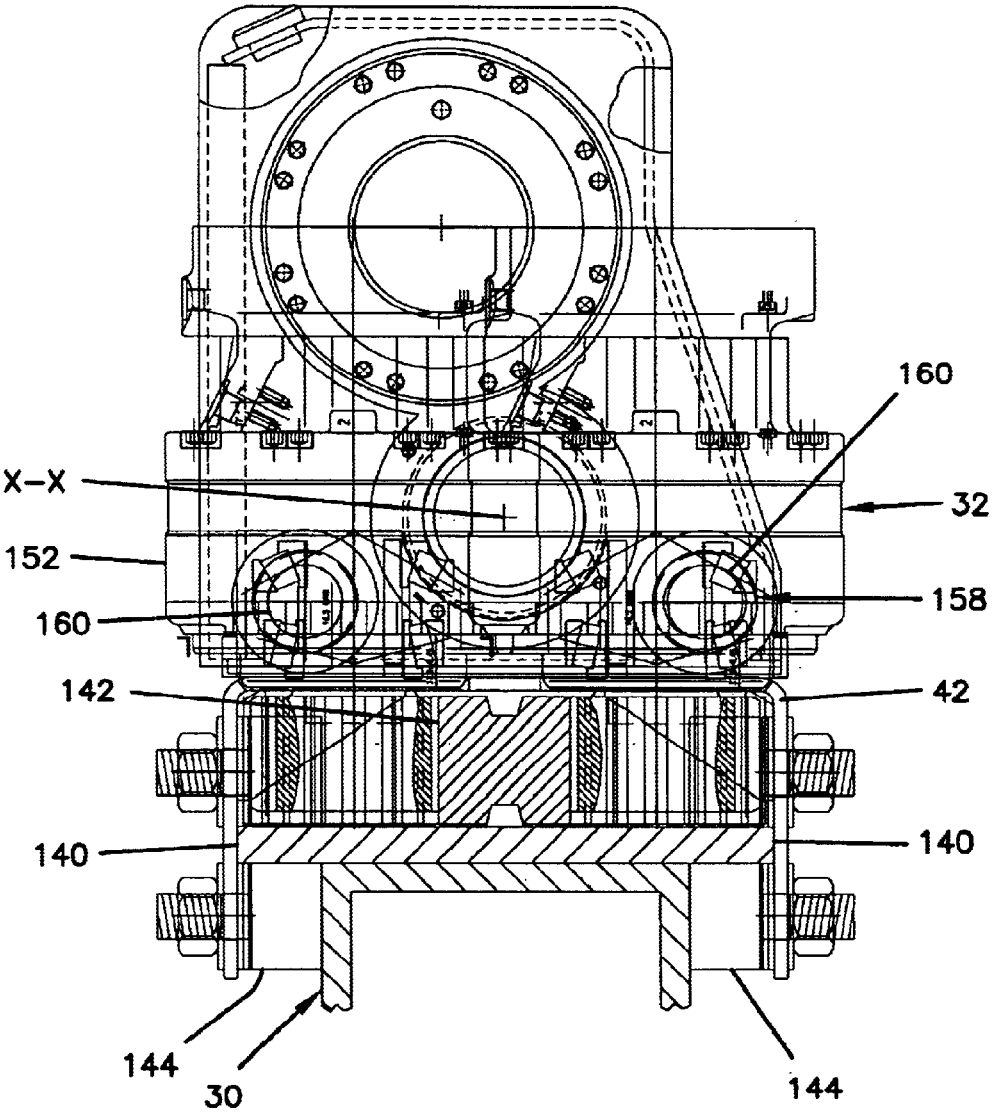
FIG. 10 is an end view of the drive head of FIG. 8.

Referring to FIGS. 8–10, the elongated track 30 of the drilling apparatus 20 includes transversely extending flanges 140 that extend along the length of the track 30. The track also includes a gear rack 142 that extends along the length of the track 30. The carriage 42 is secured to the track 30 by rollers 144 that are positioned above and below the flanges 140. The flanges 140 are captured between the rollers 144 and the rollers facilitate moving the carriage 42 along the track 30.

As shown in FIGS. 8–10, the drive mechanism 44 for moving the carriage 42 along the elongated track 30 is a rack and pinion system. The system includes pinion gears 146 that intermesh with opposite sides of the gear rack 142. The pinion gears 146 are driven by hydraulic motors 148. By driving the pinion gears 146 in a first direction, the carriage is propelled in the direction 48 along the track 30. By contrast, by driving the pinion gears 146 in a second direction, the carriage 42 is propelled in the direction 50 along the track 30.

While the drive mechanism 44 has been described as a rack and pinion system, it will be appreciated that other types of drive mechanisms could also be used. For example, chain drive systems, hydraulic/pneumatic cylinder type systems, as well as other systems, could also be used. Also, while hydraulic motors 148 are preferred, other types of drives such as pneumatic motors, electric motors, internal combustion engines or the like could also be used.

Referring to FIG. 8, the drive member 34 of the drive head 32 is mounted within bearings 150 secured to a head frame 152. A gear 154 is mounted on the drive member 34 at a location between the bearings 150. The drive mechanism 38 comprises a hydraulic motor 156 operatively coupled to the gear 154. The drive member 34 is rotated in a given direction about the drive axis X—X by torque transferred from the hydraulic motor 156 through the gear 154 to the drive member 34. In addition to the hydraulic motor 156, other types of drive arrangements (e.g., electric motors, pneumatic motors, internal combustion engines or the like) could also be used.

The head frame 152 is connected to the carriage 42 by a slide structure 158 that forms a mechanical interface between the drive head 32 and the carriage 42. The slide structure 158 includes two linear bearings 160 (e.g., pins, dowels, etc.) that are fixedly connected to the carriage 42 by flanges 162. The head frame 152 is slidably mounted on the linear bearings 160. For example, the head frame 152 is mounted on the linear bearings 160 between the flanges 162, and is free to slide along the linear bearings 160 between the flanges 162. In this manner, the flanges 162 form slide stops for preventing the head frame 152 from sliding off the linear bearings 160. The linear bearings 160 are preferably aligned parallel to the drive axis X—X.

The slide structure 158 is arranged and configured to allow the drive head 32 to move along the drive axis X—X relative to the carriage 42. When a pipe is threaded on the drive member 34 of the drive head 32, the carriage 42 remains stationary relative to the track 30 while the drive head 32 is able to move along the drive axis X—X relative to the track 30. Similarly, when a pipe is unthreaded from the drive member 34 of the drive head 32, the carriage 42 remains stationary relative to the track 30 while the drive head 32 is able to move along the drive axis X—X relative to the track 30.

In use of the drilling apparatus 20, a pipe is removed from the magazine 26 and placed in coaxial alignment with the drive axis X—X. Once the drive member 34 is aligned with the drive axis X—X, the drive member 34 and the pipe are threaded together. While the drive member 32 and the pipe are threaded together, the carriage 42 is retained at a fixed location relative to the track 30, and the drive member 34 is moved axially along the drive axis X—X. The movement of the drive member 34 relative to the carriage 42 prevents binding of the drive head 32, the pipe, and the track 30.

The slide structure 158 also assists in preventing binding of the drill apparatus 20 when a pipe is being uncoupled from the drive member 34. To uncouple a pipe, the pipe is commonly clamped or vice gripped. Next, the drive member 34 is unthreaded from the pipe. As the drive member and the pipe are unthreaded, the carriage 42 is retained at a fixed location relative to the track 30, and the drive member 34 moves axially along the drive axis X—X. Finally, the uncoupled pipe is loaded back into the magazine 28.

In addition to allowing the drive head 32 to slide relative to the carriage 42, the slide mechanism also allows torque to be transferred between the drive head 32 and the carriage 42. For example, when torque is applied to the drive member 34 by the drive mechanism 38, a reactive torque load is applied through the slide structure 158 to the carriage 42. From the carriage 42, the reactive torque load is transferred to the track 30.

It is to be understood that the present invention is not limited to the particular construction and arrangement of parts disclosed and illustrated herein, but embraces all such modified forms thereof as come within the scope of the following claims.

We claim:

1. A drilling apparatus comprising:

a) a magazine for holding a plurality of pipes, the magazine including a plurality of vertical columns;

b) a drive head including a drive member adapted to be coupled to a pipe, the drive member being aligned along a drive axis;

c) a first drive mechanism for rotating the drive member about the drive axis;

d) a second drive mechanism for moving the drive member axially along the drive axis;

e) a pipe transfer member for transferring pipes between the magazine and the drive head, the pipe transfer member defining a pipe receiving region for receiving a pipe, the pipe transfer member being movable to a transfer position where the pipe receiving region is positioned beneath the magazine; and f) a plurality of independent pipe stops, each of the independent pipe stops positioned adjacent to one of the plurality of vertical columns.

2. The drilling apparatus of claim 1, wherein each of the independent pipe stops includes at least a first pivoting arm positioned adjacent to a discharge opening of the vertical column.

3. The drilling apparatus of claim 1, wherein each of the independent pipe stops includes first and second pivoting arms positioned adjacent to a discharge opening of the vertical column.

4. The drilling apparatus of claim 1, wherein the pipe transfer member is aligned with any one of the plurality of vertical columns when the pipe transfer members is in the transfer position.

5. The drilling apparatus of claim 1, further including a release mechanism configured to selectively engage one of the plurality of independent pipe stops when the pipe transfer member is positioned in the transfer position.

6. The drilling apparatus of claim 5, wherein the release mechanism engages one of the plurality of independent pipe stops only when the pipe receiving region of the pipe transfer member is empty.

7. The drilling apparatus of claim 5, wherein the release mechanism includes a release member positionable in an actuating position to contact one of the independent pipe stops and release a pipe contained within the vertical column.

8. The drilling apparatus of claim 7, further including a pipe lift, and wherein the release member is configured to selectively engage the pipe lift such that the pipe lift moves the release member from a non-actuating position to the actuating position.

9. The drilling apparatus of claim 8, wherein the release member is sliably connected to a mounting plate of the release mechanism, and is configured to selectively move relative to the mounting plate at a sliding connection from the non-actuating position to the actuating position.

10. The drilling apparatus of claim 8, wherein the release mechanism includes a roller interconnected to a linkage, the linkage being coupled to the release member and configure to move the release member between an engagement position and a non-engagement position for selective engagement with the pipe lift.

11. The drilling apparatus of claim 10, wherein the roller is moveable along a ramped surface to pivot the linkage such that the release member is positioned in the engagement position when the roller is at an upper region of the ramped surface and the release member is positioned in the non-engagement position when the roller is at a lower region of the ramped surface.

12. The drilling apparatus of claim 10, wherein release member is positioned in the non-engagement position when the pipe receiving region of the pipe transfer member contains a pipe.

13. The drilling apparatus of claim 12, wherein the release mechanism further includes a spring chamber configured to compress when the pipe receiving region of the pipe transfer mechanism contains a pipe, the release member of the release mechanism being positioned in the non-engagement position when the spring chamber is compressed.

14. The drilling apparatus of claim 5, wherein the release mechanism is configured to translate to a home position when the transfer member is positioned in alignment with the drill head.

15. The drilling apparatus of claim 14, wherein the release mechanism includes a spring configured to bias the release mechanism to the home position when the transfer member is positioned in alignment with the drill head.

16. The drilling apparatus of claim 14, wherein the transfer member in configured to engage the release mechanism when returning to the transfer position beneath the magazine, such that both the release mechanism and the transfer member move to the transfer position in concert.

17. The drilling apparatus of claim 16, wherein the transfer member engages a pin of the release mechanism to move the release mechanism from the home position to the receiving position beneath the magazine.

18. A drilling apparatus comprising:

a) a magazine for holding a plurality of pipes, the magazine including a top end, a bottom end, and a plurality of columns extending between the top and bottom ends, the magazine further including independent pipe stops positioned adjacent each of the; and b) a pipe transfer member for transferring pipes to and from the magazine, the pipe transfer member defining a pipe receiving region for receiving a pipe, the pipe transfer member being movable to a position in which the pipe receiving region is located beneath the magazine.

19. The drilling apparatus of claim 18, wherein each of the independent pipe stops is located at the bottom end of the magazine.

20. The drilling apparatus of claim 18, further including a release mechanism interconnected to the pipe transfer member, the release mechanism being configured to actuate a selected pipe stop to release a pipe from one of the columns of the magazine.

21. The drilling apparatus of claim 20, further including a pipe lift, and wherein the release mechanism actuates a selected pipe stop when the pipe lift is raised to transfer a pipe from the one column of the magazine to the pipe transfer member.

22. A drilling apparatus comprising:

a) a magazine for holding a plurality of pipes, the magazine including a plurality of vertical columns;

b) a drive head including a drive member adapted to be coupled to a pipe, the drive member being aligned along a drive axis;

c) a first drive mechanism for rotating the drive member about the drive axis;

d) a second drive mechanism for moving the drive member axially along the drive axis;

e) a pipe transfer member for transferring pipes between the magazine and the drive head, the pipe transfer member defining a pipe receiving region for receiving a pipe, the pipe transfer member being movable to a position where the pipe receiving region is positioned beneath the magazine; and f) a plurality of individual pipe stops, each of the individual pipe stops being positioned adjacent to one of the plurality of vertical columns.

23. The drilling apparatus of claim 22, wherein each of the individual pipe stops is configured to be separately actuated.

24. The drilling apparatus of claim 23, wherein the individual, separately actuated pipe stops are positioned at discharge openings of the vertical columns.

25. A method of drilling comprising:

a) storing a plurality of pipes in a magazine, the magazine including a plurality of columns with independent pipe stops positioned adjacent to each column;

b) positioning a pipe transfer member under a selected column for transferring pipes to and from the magazine;

c) raising a pipe lift and releasing a pipe from the selected column; and d) lowering the pipe lift and transferring a pipe from the selected column to the pipe transfer member.

26. The method of claim 25, wherein only a single pipe is transferred by the pipe transfer member.

27. The method of claim 25, wherein the step of raising a pipe lift and releasing a pipe from the selected column further includes:

a) positioning a release member in an engagement position;

b) raising the pipe lift to engage the release member and further raising both the pipe lift and the release member; and c) wherein raising both the pipe lift and the release member includes raising the release member to actuate one of the independent pipe stops to release a pipe from the selected column.

28. A method of drilling comprising:

a) storing a plurality of pipes in a magazine, the magazine including a plurality of columns with independent pipe stops located adjacent to each column;;

b) positioning a pipe transfer member under a selected column for transferring pipes to and from the magazine; and c) raising a pipe lift and returning a pipe from the pipe transfer member to the selected column of the magazine.

29. The method of claim 28, wherein the step of raising a pipe lift and returning a pipe from the selected column further includes positioning a release member in a non-engagement position and raising the pipe lift without engaging the release member.

30. The method of claim 29, wherein raising the pipe lift without engaging the release member includes raising the pipe lift without raising the release member to actuate the independent pipe stops.

* * * * *

UNITED STATES PATENT AND TRADEMARK OFFICE

CERTIFICATE OF CORRECTION

PATENT NO. : 6,814,164 B2
APPLICATION NO. : 10/391230
DATED : November 9, 2004
INVENTOR(S) : Mills et al.

It is certified that error appears in the above-identified patent and that said Letters Patent is hereby corrected as shown below:

Title page, (57) Abstract, line 2: “a drive head is disclosed herein.” should read --a drive head.--

Col. 15, line 62, claim 9: “member is sliably connected” should read --member is slidably connected--

Col. 16, line 30, claim 16: “member in configured” should read --member is configured--

Col. 16, line 42, claim 18: “each of the; and” should read --each of the columns; and--

Col. 18, line 16, claim 28: “each column;;” should read --each column;--

Signed and Sealed this

Twenty-third Day of January, 2007

JON W. DUDAS
*Director of the United States Patent and Trademark Office*